US010414064B1

(12) United States Patent
Laster et al.

(10) Patent No.: US 10,414,064 B1
(45) Date of Patent: Sep. 17, 2019

(54) EFFICIENT METHOD AND APPARATUS FOR PRODUCING COMPRESSED STRUCTURAL FIBERBOARD

(71) Applicant: Agriboard International, LLC, Wichita, KS (US)

(72) Inventors: Frank Laster, Leedey, OK (US); Larry Ryan, Yukon, OK (US)

(73) Assignee: Agriboard International, LLC, Wichita, KS (US)

( * ) Notice: Subject to any disclaimer, the term of this patent is extended or adjusted under 35 U.S.C. 154(b) by 0 days.

(21) Appl. No.: 16/353,624

(22) Filed: Mar. 14, 2019

(51) Int. Cl.

| | |
|---|---|
| ***B27N 3/28*** | (2006.01) |
| ***B27N 3/04*** | (2006.01) |
| ***B27N 1/02*** | (2006.01) |
| ***B27N 3/18*** | (2006.01) |

(52) U.S. Cl.
CPC ..... *B27N 3/04* (2013.01); *B27N 1/029* (2013.01); *B27N 3/183* (2013.01); *B27N 3/28* (2013.01)

(58) Field of Classification Search
USPC ..... 162/218, 221–225, 231, 293, 382, 407
See application file for complete search history.

(56) References Cited

U.S. PATENT DOCUMENTS

| | | | |
|---|---|---|---|
| 3,064,357 | A | 11/1962 | Butters |
| 3,890,077 | A | 6/1975 | Holman |
| 3,967,912 | A | 7/1976 | Parker |
| 4,025,278 | A | 5/1977 | Tilby |
| 4,212,616 | A | 7/1980 | Tilby |
| 4,451,322 | A | 5/1984 | Dvorak |
| 5,413,746 | A | 5/1995 | Birjukov |
| 5,459,318 | A | 10/1995 | Cacho |
| 5,498,478 | A | 3/1996 | Hansen et al. |
| 5,632,848 | A | 5/1997 | Richards et al. |
| 5,656,129 | A | 8/1997 | Good et al. |
| 5,730,830 | A | 3/1998 | Hall |
| 5,945,132 | A | 8/1999 | Sullivan et al. |

(Continued)

FOREIGN PATENT DOCUMENTS

| | | | |
|---|---|---|---|
| DE | 4034610 | A1 | 5/1992 |
| DE | 102006004779 | A1 | 8/2007 |

(Continued)

*Primary Examiner* — Dennis R Cordray
(74) *Attorney, Agent, or Firm* — Young Basile Hanlon & MacFarlane, P.C.

(57) ABSTRACT

An efficient method and apparatus for making a compressed structural fiberboard from agricultural fibrous matter. The method and apparatus provides a conveyor having variable drives for carrying the agricultural fibrous matter; a hopper having variable drives for conditioning and delivering the agricultural fibrous matter to an extruder; the extruder having a cyclic ram with linear actuators and a floating plate to drive the cyclic ram between an extended position, wherein the agricultural fibrous matter is compacted into the compressed structural fiberboard, and a retracted position, wherein the agricultural fibrous matter is delivered to the extruder; synthetic oil heaters for heating the compressed structural fiberboard; a heat sink track cooler for cooling the compressed structural fiberboard; and a water jet cutting system for cutting the compressed structural fiberboard into individual boards.

15 Claims, 20 Drawing Sheets

(56) References Cited

U.S. PATENT DOCUMENTS

| | | | | |
|---|---|---|---|---|
| 6,143,220 | A * | 11/2000 | Sullivan | B27N 3/04 264/109 |
| 6,346,165 | B1 | 2/2002 | Markessini | |
| 6,546,986 | B1 | 4/2003 | Waggoner et al. | |
| 6,596,209 | B2 | 7/2003 | Uhland et al. | |
| 7,921,800 | B2 | 4/2011 | Huddy et al. | |
| 8,052,842 | B2 | 11/2011 | Pittman et al. | |
| 8,163,352 | B2 | 4/2012 | Jones | |
| 9,539,738 | B2 | 1/2017 | Iredi | |
| 2007/0049661 | A1 | 3/2007 | Neel et al. | |
| 2010/0003431 | A1 | 1/2010 | Raybuck | |
| 2011/0027566 | A1 | 2/2011 | Lee et al. | |
| 2013/0295352 | A1 | 11/2013 | Thiers et al. | |
| 2014/0363606 | A1 | 12/2014 | Moeller et al. | |

FOREIGN PATENT DOCUMENTS

| | | | |
|---|---|---|---|
| DE | 102006055116 | A1 | 5/2008 |
| EP | 0908281 | A1 | 4/1999 |
| GB | 090361 | A | 4/1965 |
| SU | 650832 | A1 | 3/1979 |
| SU | 1020251 | A1 | 5/1983 |
| WO | 02059433 | A2 | 8/2002 |

* cited by examiner

EFFICIENT METHOD AND APPARATUS FOR PRODUCING COMPRESSED STRUCTURAL FIBERBOARD

CROSS-REFERENCE TO RELATED APPLICATIONS

None.

TECHNICAL FIELD

The present disclosure relates to architectural structural materials, and more particularly, to an efficient method and apparatus for compressing agricultural fibrous matter, such as straw, wherein certain processing levels and controls provide a more efficient and consistent load-bearing and insulating panel for making a compressed structural fiberboard usable in the building industry.

BACKGROUND

The process for producing man-made board products from cellulosic fibers, especially wood chips or other low-quality forest or wood residues, are well known to those skilled in the art. However, wood by-products are becoming increasingly more expensive and difficult to obtain as natural wood resources continually become more depleted, especially in third world countries and environments that are undesirable for producing wood. Furthermore, particle boards produced from such wood residues have been shown to be highly flammable. Thus, it has been desirable to replace the wood residues in the board production process with more easily obtainable agricultural waste products that are less expensive, less flammable, more abundant, and of the same or better quality than wood residue boards.

The concept of using waste agricultural products, such as straw, to build relatively permanent domiciles and other generally permanent buildings is well known. This concept includes replacing typical floors, wooden or metal stud walls, and ceilings and roof constructions normally used for on-site fabrication with panel boards made from agricultural fibers. The panel boards of this nature made in the past have had the structural and insulation properties of the conventional structures that they replaced.

Although the basic concept has been around for some time, various anomalies have prevented the commercial dominance of this concept over standard approaches. For instance, in the past, it has been difficult to manufacture such agricultural fiberboards that have a reliable and consistent density in the core of the fiberboard. In addition, the relatively high cost of manufacturing such a fiberboard was also a considerable problem.

Applicant resolved the problems of the past by inventing a method and apparatus for making compressed agricultural fiber structural board, as seen and disclosed in U.S. Pat. Nos. 5,945,132 and 6,143,220. Although the inventions described in the above-noted patents led to the creation of a relatively low-cost fiberboard having a core with a substantially consistent density, it was determined that certain inconsistencies and inefficiencies were leading to rather large variances in the quality and the cost of the fiberboard. For instance, the straw utilized to create the fiberboard contains various moisture levels depending on the type of straw and the time of year in which the straw is harvested. Since moisture is a key factor in the resulting density of the core of the fiberboard, the failure to control the moisture level in the straw prior to and during the fiberboard manufacturing process led to undesirable variances in the density of the core of the fiberboard. In addition, due to the structural integrity of straw, it is often difficult to provide a consistent amount of straw throughout the process once the straw is separated and cleaned. Failure to provide a consistent amount of straw throughout the process may lead to inconsistencies in the density of the fiberboard. These and other various processing factors led to certain inconsistencies and inefficiencies that were undesirable in a manufacturing environment.

Applicant further resolved the issues described above by disclosing a method for making a compressed structural fiberboard in U.S. Pat. No. 8,052,842. Although the method disclosed in the above-noted patent provided an improved method for making a compressed structural fiberboard over the previous methods, the disclosed process was still too inefficient to be competitive with other similar building materials in the building industry. For instance, the previous process for manufacturing compressed fiberboard was slow and required a high level of energy thereby leading to inefficiencies that increased the cost of manufacturing the compressed fiberboard. Also, the equipment and machinery used to produce the compressed fiberboard was large and heavy thereby requiring large amounts of factory floor space and reinforced foundations which added to the cost of manufacturing the compressed fiberboard. In addition, the process for producing the compressed structural fiberboard lacked sufficient industrial controls for monitoring and controlling the manufacturing process thereby leading to lower output rates and quality with higher levels of scrap rates. All of these factors led to inefficiencies that are undesirable in an industrial environment.

It is desirable to produce an efficient method and apparatus for producing a compressed structural fiberboard that can compete with similar building products in the building industry.

SUMMARY

The present disclosure provides an efficient method for making a compressed structural fiberboard from agricultural fibrous matter. The method includes the steps of providing a preselected volume of the agricultural fibrous matter; preconditioning the agricultural fibrous matter to have a first predetermined moisture level within the agricultural fibrous matter; extruding the agricultural fibrous matter to form a continuous compressed structural fiberboard wherein the extruding ram is actuated and driven by linear actuators; monitoring the density of the compressed structural fiberboard; and utilizing a programmable logic controller to monitor and adjust the speed at which the compressed structural board is produced to control the density of the compressed structural fiberboard.

The present disclosure also provides an efficient apparatus for making a compressed structural fiberboard from agricultural fibrous matter. The apparatus provides a conveyor having variable drives for carrying the agricultural fibrous matter; a hopper having variable drives for conditioning and delivering the agricultural fibrous matter to an extruder; the extruder having a cyclic ram with linear actuators and a floating table to drive the cyclic ram between an extended position, wherein the agricultural fibrous matter is compacted into the compressed structural fiberboard, and a retracted position, wherein the agricultural fibrous matter is delivered to the extruder.

BRIEF DESCRIPTION OF THE DRAWINGS

The present disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
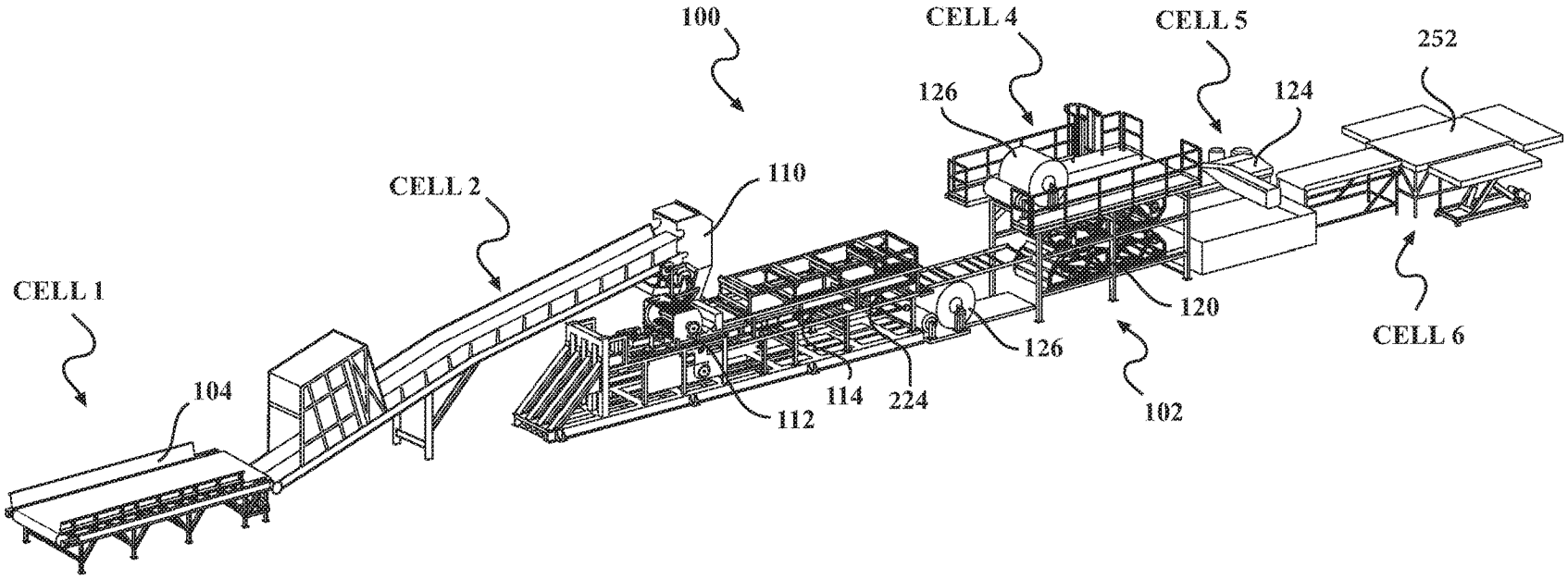
FIG. 1 is a left perspective view of a method and apparatus for manufacturing compressed structural fiberboard.

With reference to FIGS. 1-20, the present disclosure provides an efficient method and apparatus 100 for manufacturing a compressed structural fiberboard 101 from an agricultural fibrous material, such as rice straw (not shown). Such compressed structural board 101 may be utilized to construct various buildings, including domiciles. Various cladding may be used in combination with the compressed structural fiberboard 101 to allow the compressed structural fiberboard 101 to be used as either an exterior or interior panel of a building. The compressed structural fiberboard 101 has many properties which allow it to be used as a building panel. For example, the compressed structural fiberboard 101 may be load-bearing while also providing for thermal and sound insulation. In addition, the compressed structural fiberboard 101 may be used to make filler panels for post and beam types of construction. Compressed structural fiberboards 101 may be fabricated into various thicknesses, lengths, and widths depending on the application of the fiberboard 101. In addition, a range of densities can be utilized in constructing the fiberboard 101.

The method and apparatus 100 of the present disclosure is designed for use with rice straw 103 or the like. Rice straw 103 is the preferred fibrous matter for creating the compressed structural fiberboard 101, as rice straw 103 typically does not contain dirt and/or rocks, thereby eliminating the need to clean the rice straw 103 via straw walkers or other devices and eliminating the loss of straw through cleaning operations. The elimination of straw walkers and vacuums for cleaning reduces the cost of the equipment and maintenance, and the reduction of the loss of straw increases the efficiency of the manufacturing process. Rice straw 103 provides a higher quality of straw than other types of straw which creates less variability on production machinery and board quality thereby further increasing the efficiency of the manufacturing process. However, it will be recognized by those skilled in the art that there are agricultural products grown for the specific purpose of being converted into a building structural board wherein such agricultural products could provide agricultural fibrous matter for the method and apparatus 100 of the present disclosure. Other agricultural materials contemplated for use with the invention include straw from other primary protein products, such as wheat, barley, oats, and rice. It is also contemplated that the invention can be used with materials other than straw, such as sugarcane, bagasse, coconut husk, Johnson and switch grasses, etc. It has been determined through experimentation that rice straw 103 having individual pieces of 18"-20" long provide the most consistent compressed structural fiberboard 101. Bales of rice straw 103 weighing 45 lbs. may be used; however, bales of rice straw 103 having various sizes and weight may be used. Each finished compressed structural fiberboard 101 may have dimensions of 48"×96"×3.5" and weigh 160 lbs. with a final fiberboard density of 18 lbs./ft$^3$; however, other sizes and densities of compressed structural fiberboard 101 are possible. Since rice straw 103 has been determined to be the most advantageous agricultural fibrous matter for the method and apparatus 100 of the present disclosure, rice straw 103 will be referred to as the straw or agricultural fibrous matter throughout the present disclosure.

Figure 2:
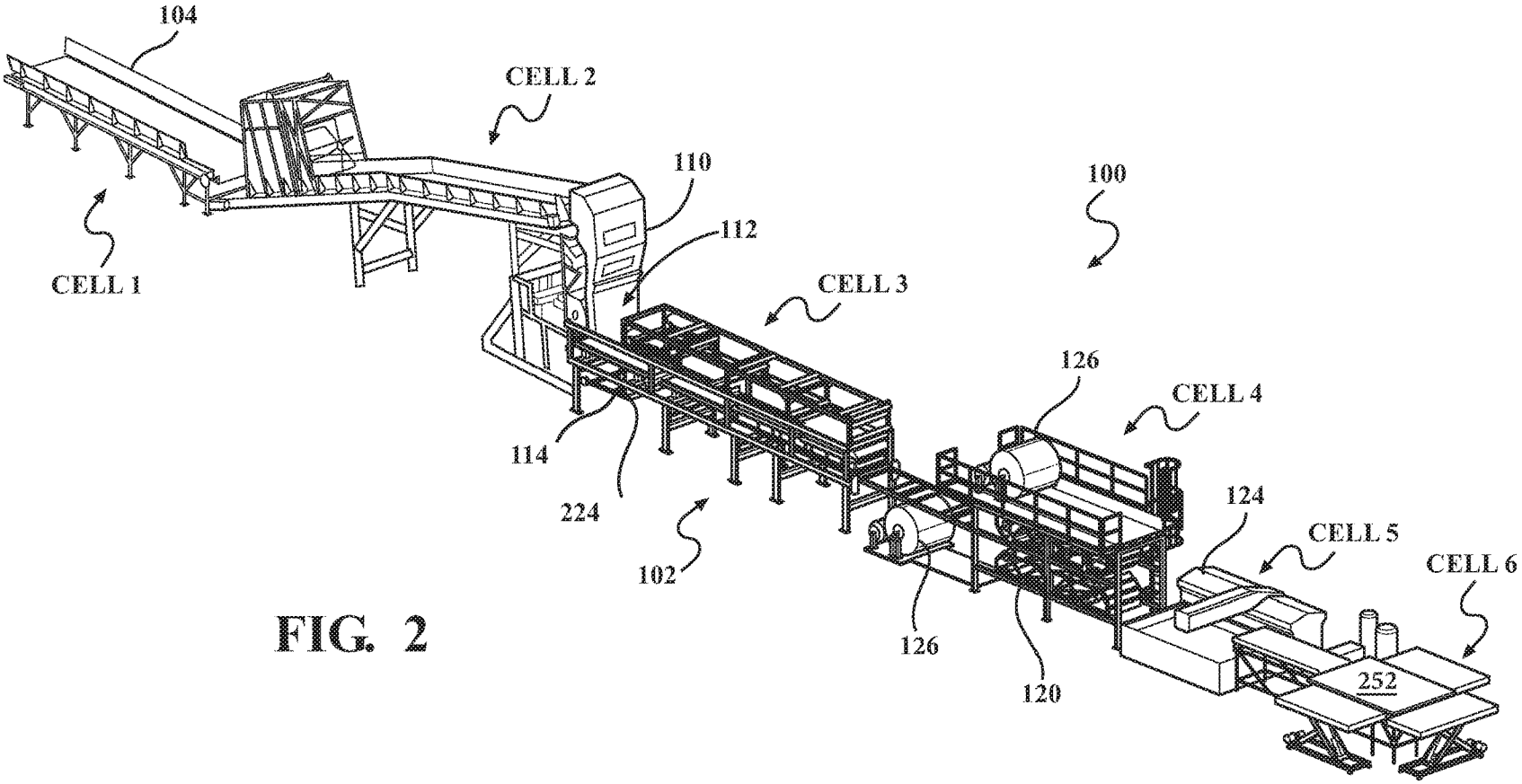
FIG. 2 is a right perspective view of the method and apparatus for manufacturing compressed structural fiberboard.

The method and apparatus 100 for manufacturing a compressed structural fiberboard 101 may be described as a mill 102 divided into six cells, i.e. Cells 1-6, as shown in FIG. 1-2. As shown in FIGS. 1-2, Cell 1 includes a conveyor 104 for delivering rice straw 103 to Cell 2 of the mill 102 wherein steam (not shown) and borax (not shown) are applied to the rice straw 103. The rice straw 103 is then conveyed to Cell 3 wherein the rice straw 103 is fed through a hopper 110, extruded through an extruder 112, and heated in an oven 114 where a continuous compressed structural fiberboard 101 is formed. The compressed structural fiberboard 101 is wrapped in containment material 105, such as paper 116, and sent through a second oven 224 wherein dry glue on the paper 116 is activated to stick to the compressed structural fiberboard 101. The compressed structural fiberboard 101 is then conveyed to Cell 4 where the compressed structural fiberboard 101 is cooled by a heat sink track cooler 120. The compressed structural fiberboard 101 continues to Cell 5 where the compressed structural fiberboard 101 is cut into individual and separate boards by a water jet cutting machine 124. The cut compressed structural fiberboards 101 travel to Cell 6 where the compressed structural fiberboards 101 are placed on an air table 252 to weigh, label, cap, and unload the compressed structural fiberboards 101 from the mill 102.

Prior to loading the rice straw 103 into the mill 102, the bales of rice straw 103 are preconditioned to control the moisture content in the rice straw 103. This may be completed by allowing the rice straw 103 to dry in ambient air, through the use of a dehumidifier (not shown), or in an oven (not shown) until the moisture content is within a range of 11-15%. Due to the importance of the moisture content in the rice straw 103 in controlling the consistency of the compressed structural fiberboard 101, the moisture level in the rice straw 103 should be controlled to the tightest tolerances possible. Therefore, the moisture content of the rice straw 103 should first be measured before loading the rice straw 103 into the mill 102 to ensure that the moisture level is within 11-15%. If the rice straw 103 is not within the desired moisture level, then the rice straw 103 should be allowed to dry further, and if the rice straw 103 is within the permissible range, then the rice straw 103 should be loaded into the mill 102. The moisture levels of the rice straw 103 can be measured either manually or through the use of infrared sensors (not shown). By monitoring the moisture level of the rice straw 103 prior to being loaded into the mill 102, the moisture level within the rice straw 103 can be monitored and controlled thoroughly throughout the manufacturing process thereby leading to a more consistent and higher quality compressed structural fiberboard 101.

Once the bales of rice straw 103 are at acceptable moisture levels, the bales of rice straw 103 are delivered to Cell 1 wherein the rice straw 103 is prepared to be loaded onto the mill 102. Twine or other tying materials (not shown) which hold the bales of rice straw 103 together are removed so that the bales of rice straw 103 may be manually separated into 18"-20" long pieces, as previously described. The pieces of rice straw 103 are placed on a first conveyor 104 of Cell 1 to convey the rice straw 103 to the mill 102. The quality of the rice straw 103 not only eliminates the need for a straw walker but also eliminates the need for a flake separator and/or shredder to tear and separate the rice straw 103 thereby reducing the amount, cost, and maintenance of the equipment in the mill 102. In addition, the elimination of dirt and contaminants in the rice straw 103, as well as the elimination of straw walkers and flake separators, greatly reduces the amount of dust created from the rice straw 103 thereby eliminating the need to capture and exhaust the dust in and from a housing of the mill 102. The lack of dust greatly improves the environmental conditions in the manufacturing facility housing the mill 102 and eliminates the cost and maintenance of exhaust equipment.

Figure 3:
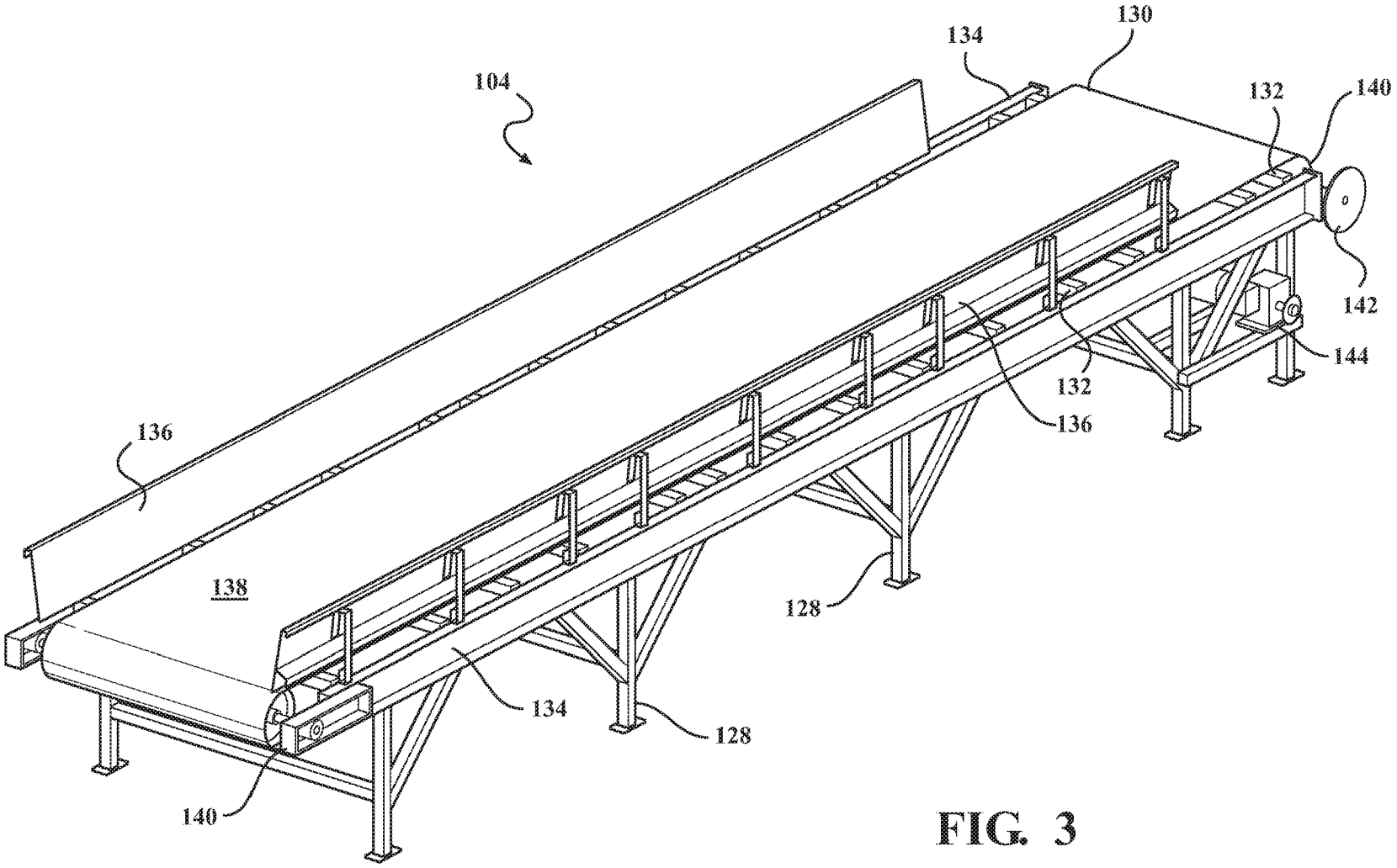
FIG. 3 is a perspective view of Cell 1 of the method and apparatus for manufacturing compressed structural fiberboard shown in FIGS. 1-2.

As seen in FIG. 3, the conveyor 104 in Cell 1 includes a number of vertical support legs 128 that support a substantially horizontal roller conveyor 130 having rollers 132 that extend between and are rollably supported by a pair of substantially parallel supports 134. A guide rail 136 is connected to and extends upward from each parallel support 134 to maintain and guide the rice straw 103 on the conveyor 104. A continuous conveyor belt 138 extends around the top sides and the bottom sides of the rollers 132 and carries the rice straw 103 along the conveyor 104. A cylindrical pulley 140 is rotatably connected to each end of the conveyor 104 such that the continuous conveyor belt 138 extends around the pulley 140. A sprocket 142 is connected to the pulley 140, and a belt or chain (not shown) connects the sprocket 142 to a variable speed drive 144 mounted to the supports 134 of the conveyor 104. The variable speed drive 144 is controlled by a variable speed controller (not shown) which controls the speed of the continuous belt 138 thereby controlling the speed at which the rice straw 103 is fed to the mill 102 and in turn controlling the volume of rice straw 103 provided to the mill 102. The conveyor 104 can travel at speeds of 40 ft./min to 100 ft./min. The variable speed controller may communicate with other controllers within the mill 102 and may be controlled by a control system 256, as will be described later therein.

Figure 4:
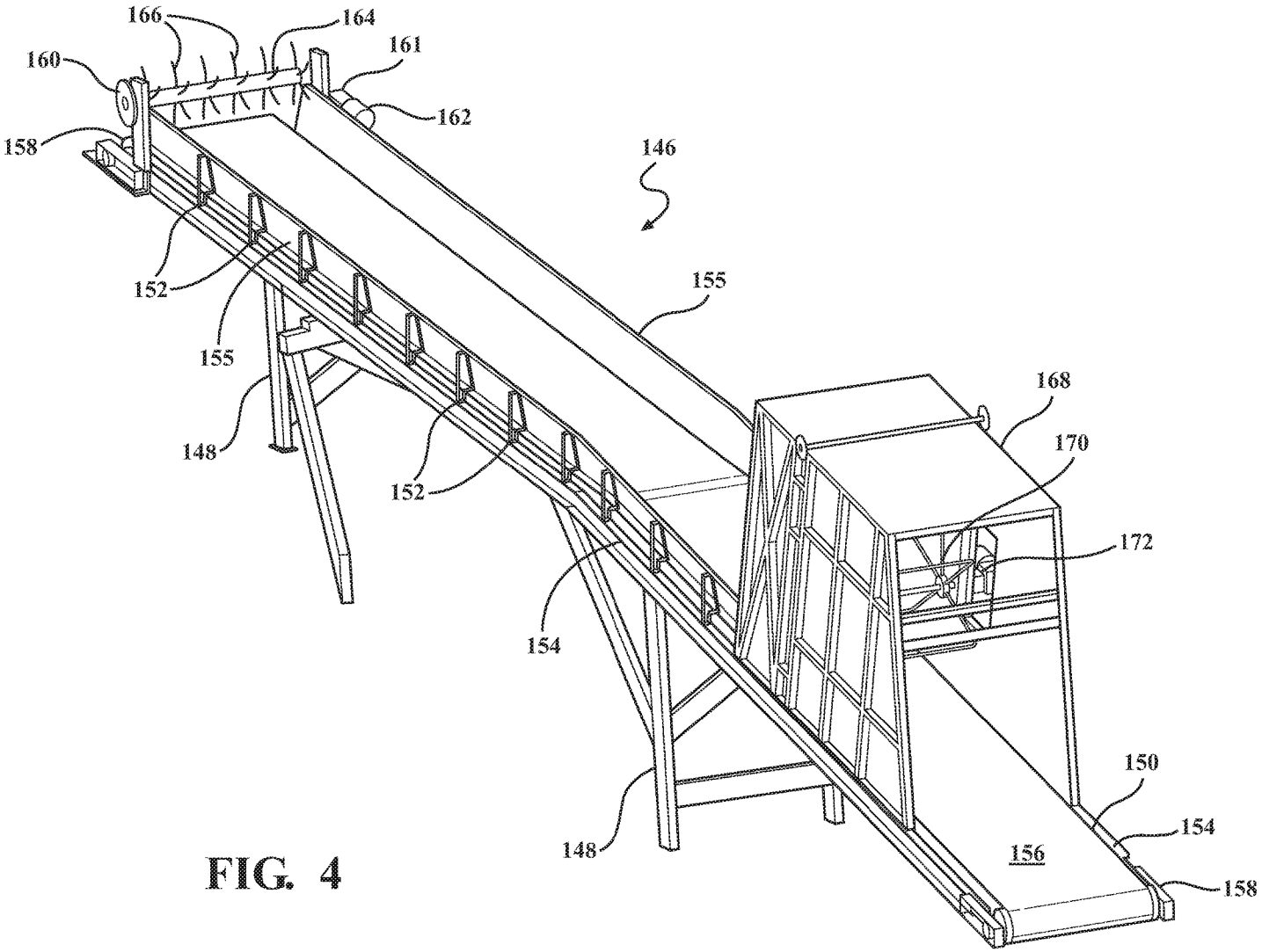
FIG. 4 is a perspective view of Cell 2 of the method and apparatus for manufacturing compressed structural fiberboard shown in FIGS. 1-2.

The rice straw 103 travels from the first conveyor 104 of Cell 1 to a second conveyor 146 in Cell 2. The second conveyor 146 is similar to the first conveyor 104 in Cell 1; however, the second conveyor 146 extends at an upward angle from the first conveyor 104, as shown in FIG. 4. The second conveyor 146 provides support legs 148 for supporting a roller conveyor 150 having rollers 152 that are rollably supported by a pair of substantially parallel side supports 154. A guide rail 155 is connected to and extends upward from each parallel support 154 to maintain the rice straw 103 on the conveyor 146. A continuous belt 156 extends over the top and underside of the rollers 152 and carries the rice straw 103 along the second conveyor 146. A cylindrical pulley 158 is rotatably connected to each end of the conveyor 146 such that the continuous belt 156 extends around the pulleys 158. A rotational shaft 164 is mounted above the second conveyor 146 and one of the pulleys 158 wherein the rotational shaft 164 has elongated fingers 166 extending therefrom for evenly sorting the rice straw 103 as the rice straw 103 approaches Cell 3. A sprocket 160 is connected to the rotational shaft 164 wherein a chain or belt (not shown) may connect the sprocket 160 to the pulley 158. The pulley 158 may be rotatably driven by a variable speed drive 162 mounted to the side support 154 of the conveyor 146. A gearbox 161 is connected to the variable speed drive 162 and allows for changing the gear ratios between the variable speed drive 162 and the pulley 158 such that different ranges of speed can be applied to the conveyor 146 and the rotatable shaft 164. The variable drive 162 is controlled by a variable speed controller which controls the speed of the continuous belt 156 thereby controlling the speed and volume at which the straw is fed to the mill 102. The second conveyor 146 may also travel between speeds of 40-100 ft/min. The variable speed controller may communicate with other controllers within the mill 102 and may be controlled by the control system 256, as will be described later therein.

To provide the rice straw 103 with the proper moisture content while ensuring that mold and bacteria do not grow within the rice straw 103, borax and steam are applied to the rice straw 103 in an enclosure 168 mounted to the second conveyor 146. The enclosure 168 is substantially rectangular and is mounted above the continuous conveyor belt 156 of the second conveyor 146 so as to allow the continuous conveyor belt 156 with the rice straw 103 carried thereon to pass through the enclosure 168. A leveling reel 170 is rotatably mounted within the enclosure wherein the leveling reel 170 has a plurality of substantially U-shaped rods that rotate about a horizontal axis to engage and level the rice straw 103. A variable speed drive 172 rotatably drives the leveling reel 170 and communicates with the control system 256 to ensure the leveling reel 170 rotates at a speed commensurate with the speed of the second conveyor 146 and the remainder of the mill 102. The variable drive 172 is mounted to the enclosure 168. The leveling reel 170 levels the rice straw 103 into a straw mat (not shown) having a height of approximately 12"-18".

As the rice straw 103 passes through the enclosure 168, steam and borax are applied to the rice straw 103 to provide the rice straw 103 with a predetermined level of moisture and borax. The application of steam and heat is preferred as a method of adding water to the rice straw 103, as steam is absorbed into the rice straw 103 more efficiently than the addition of water in a liquid or mist form at a lower temperature. A steam generator (not shown) is mounted adjacent the enclosure 168 for providing steam to the rice straw 103. The steam generator provides steam at 1367 lbs./hr. @ 189 psi at a temperature of preferably and substantially above 212 degrees Fahrenheit. Spray nozzles (not shown) are positioned within the enclosure 168 and spray downward onto the passing rice straw 103. Infrared moisturizer sensors (not shown) may be mounted within the enclosure 168 to monitor the moisture content within the rice straw 103. By monitoring the infrared sensors, the amount of steam and heat applied to the rice straw 103 within the enclosure 168 may be adjusted accordingly to provide a predetermined moisture level within the rice straw 103. A preferred moisture level of 24% is preferred when the rice straw 103 exits the enclosure 168. The variable speed drive 172 of the second conveyor 146 may be adjusted in accordance with the monitoring of the moisture level of the rice straw 103 to ensure the proper moisture level is maintained. The variable speed drive 172 and the moisture sensors may communicate with other controllers within the mill 102 and be controlled by the control system 256, as will be described later therein.

A borax applicator (not shown) is also mounted adjacent the enclosure 168 and provides an applicator (not shown) within the enclosure 168. The borax applicator disperses the borax at a rate of ½ oz./ft$^2$. The borax is a powder that is mixed with water to form a solution that is preferably applied to the rice straw 103 as a steam at preferably and substantially above 212 degrees Fahrenheit; however, the borax solution may be applied at other temperatures. Applying the borax in a water solution eliminates dust from the borax powder and provides a consistent application of borax to the rice straw 103. The borax may be applied as a separate steam or in combination with the water steam noted above. The rate and amount of borax is monitored to ensure the proper levels of borax are applied as too much borax may affect the bonding of lignin in the rice straw 103 as will be described later therein. The application rate of the borax is electronically monitored in conjunction with the speed of the conveyor 146 and the variable drive 172 and controlled by the control system 256, as will be described later therein.

Figure 5:
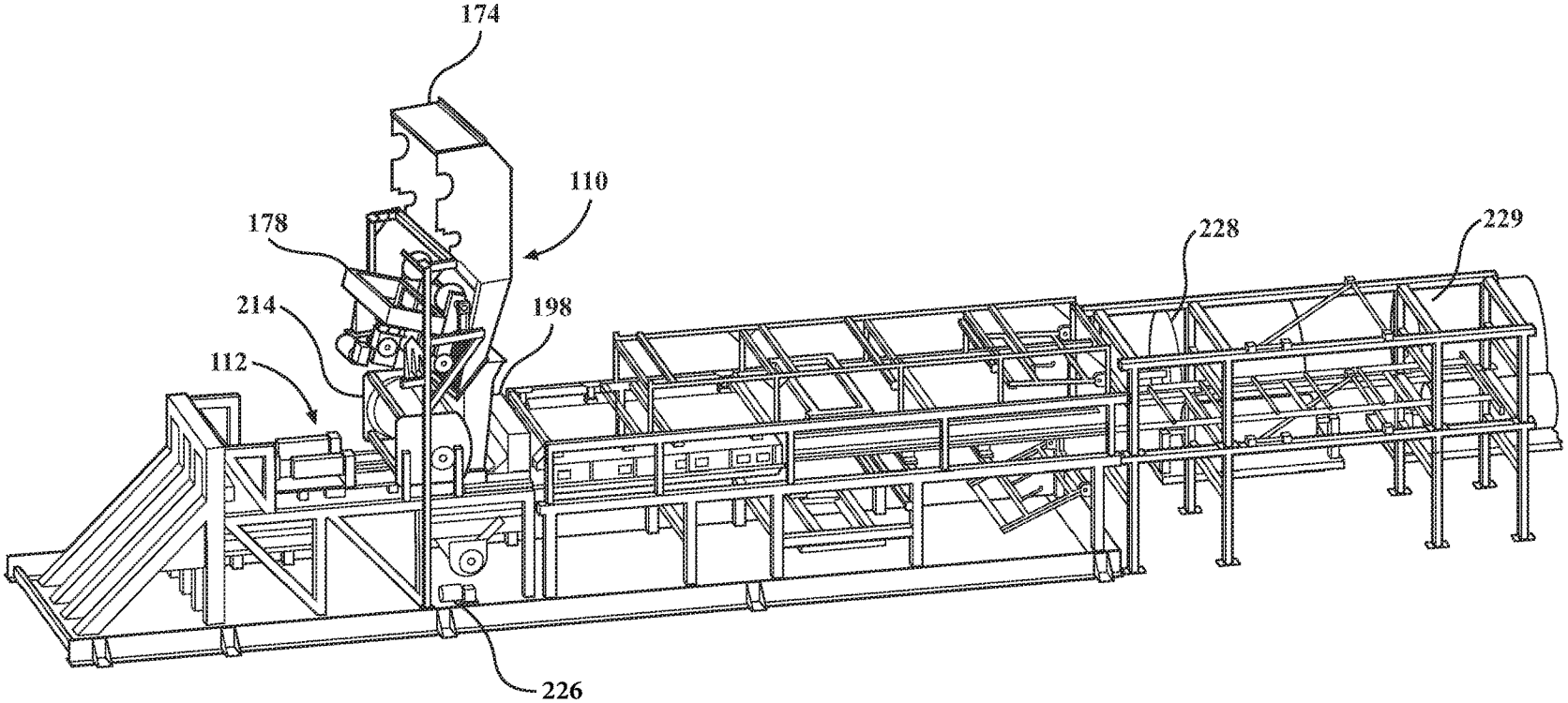
FIG. 5 is a perspective view of Cell 3 of the method and apparatus for manufacturing compressed structural fiberboard shown in FIGS. 1-2.
Figure 6:
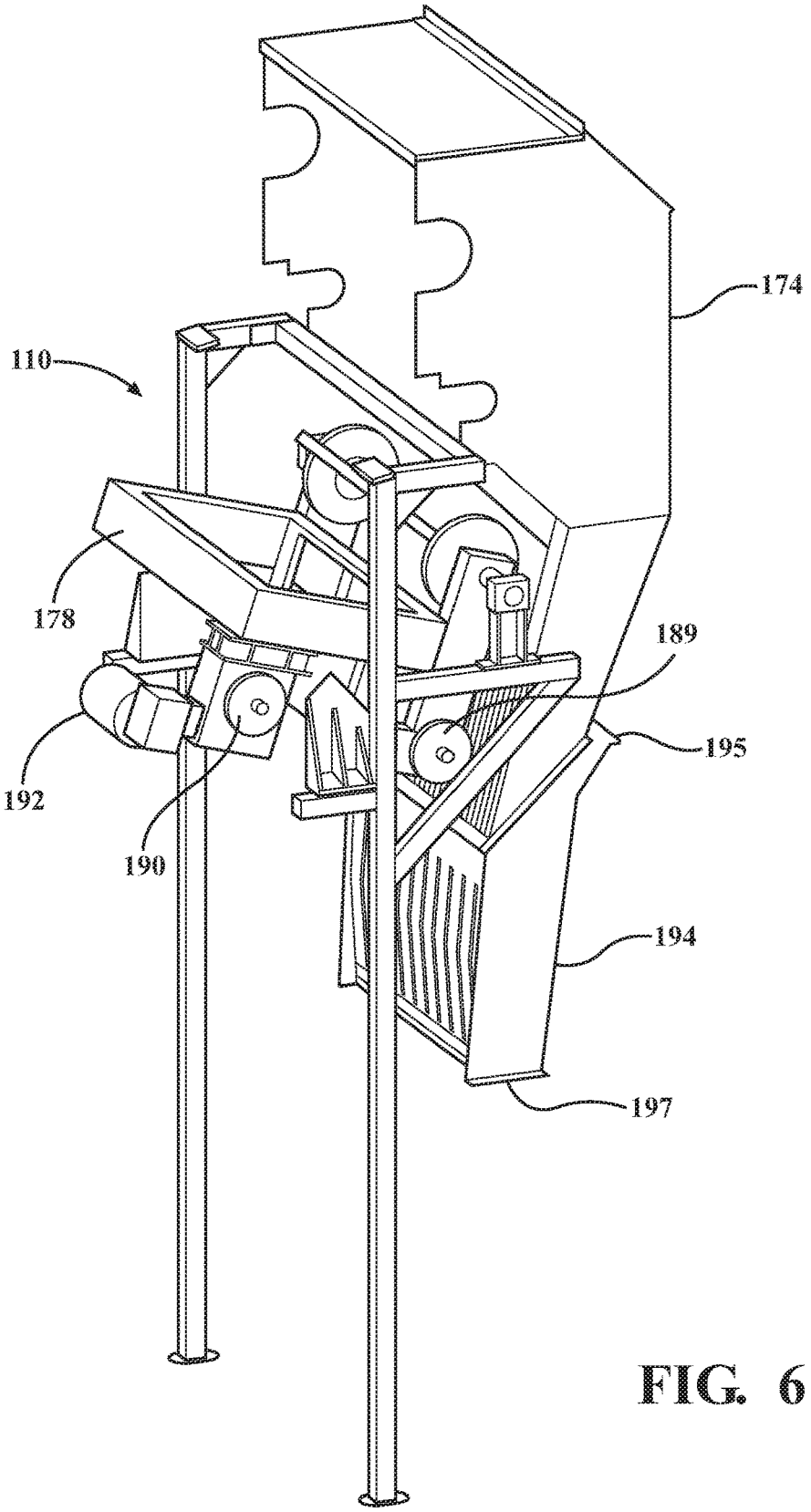
FIG. 6 is a perspective view of a hopper of Cell 3 of the method and apparatus for manufacturing compressed structural fiberboard shown in FIG. 5.
Figure 7:
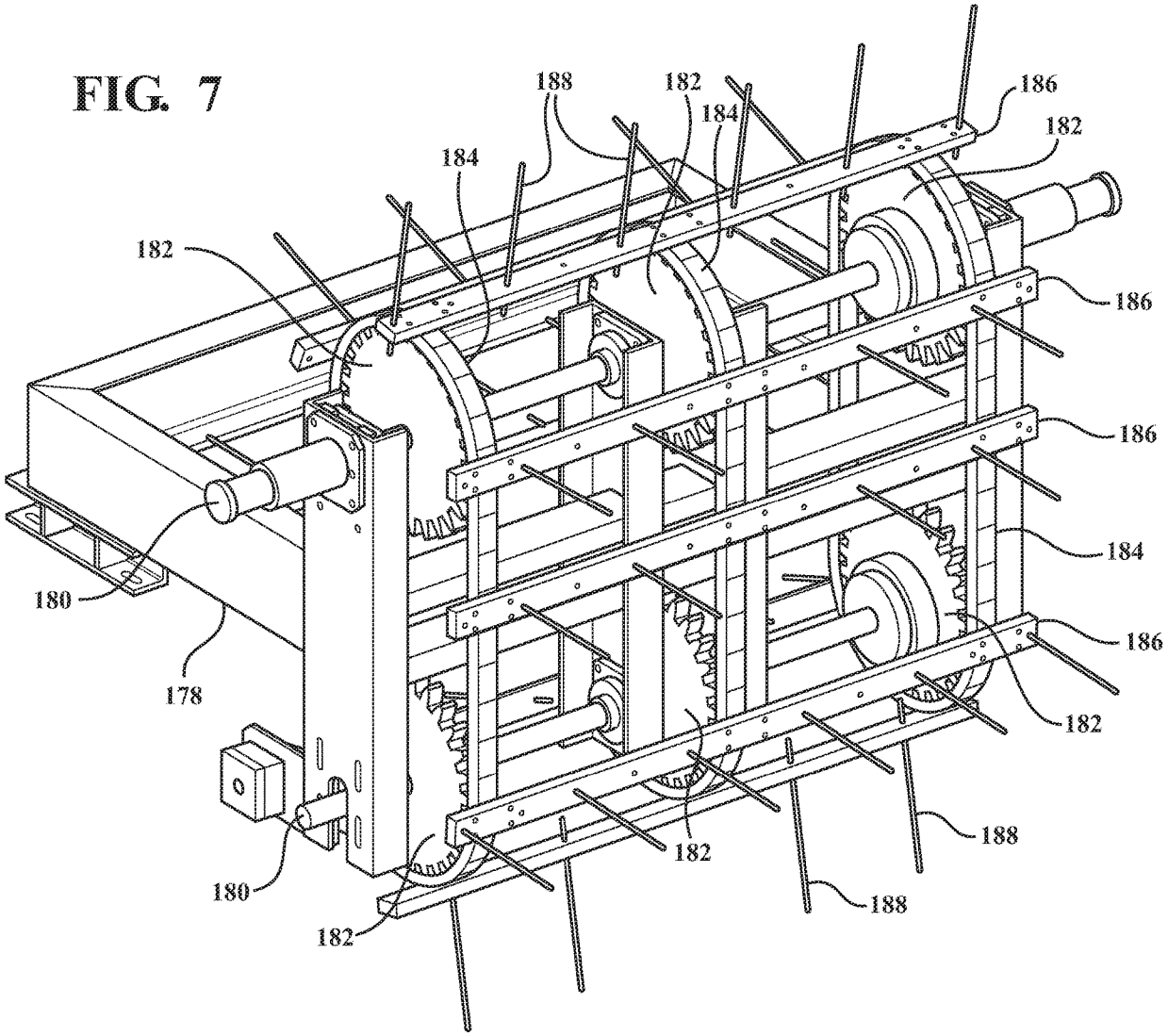
FIG. 7 is a perspective view of the fingers of the hopper of Cell 3 of the method and apparatus for manufacturing compressed structural fiberboard shown in FIG. 5.
Figure 8:
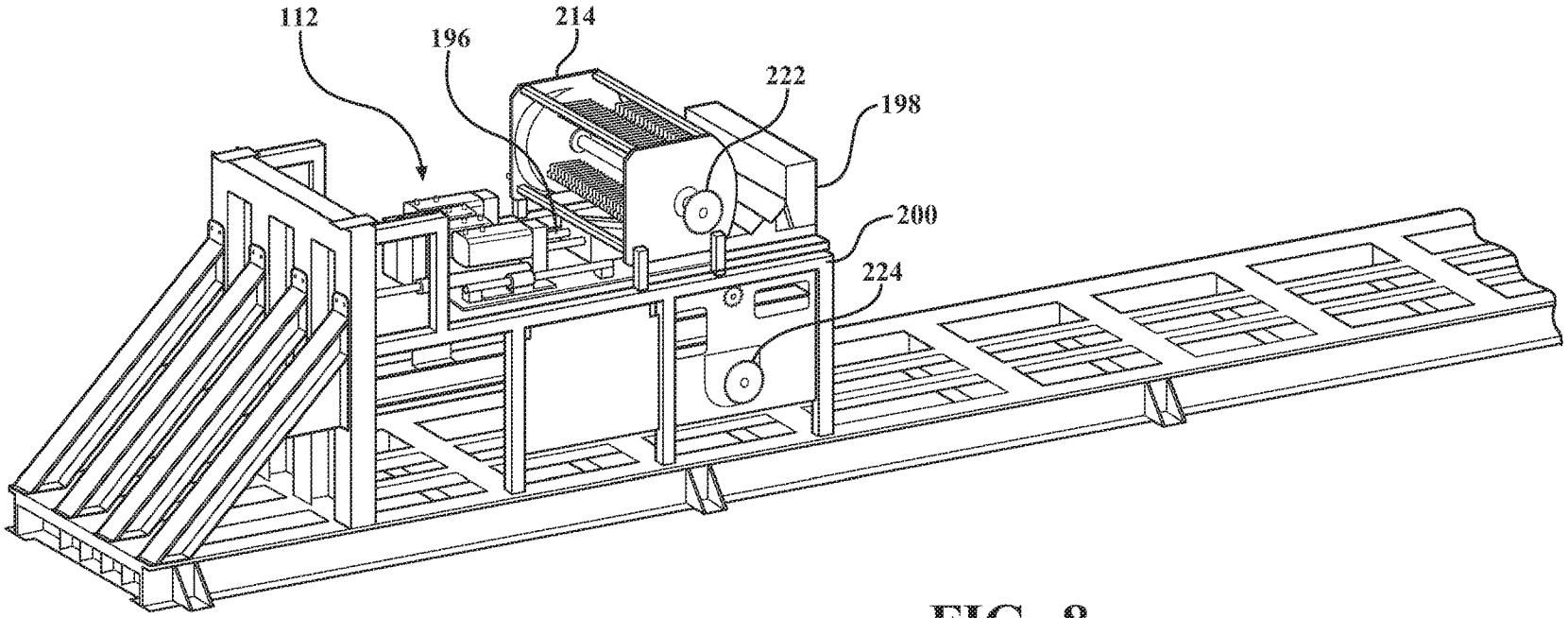
FIG. 8 a perspective view of a packer and extruder of Cell 3 of the method and apparatus for manufacturing compressed structural fiberboard shown in FIG. 5.
Figure 9:
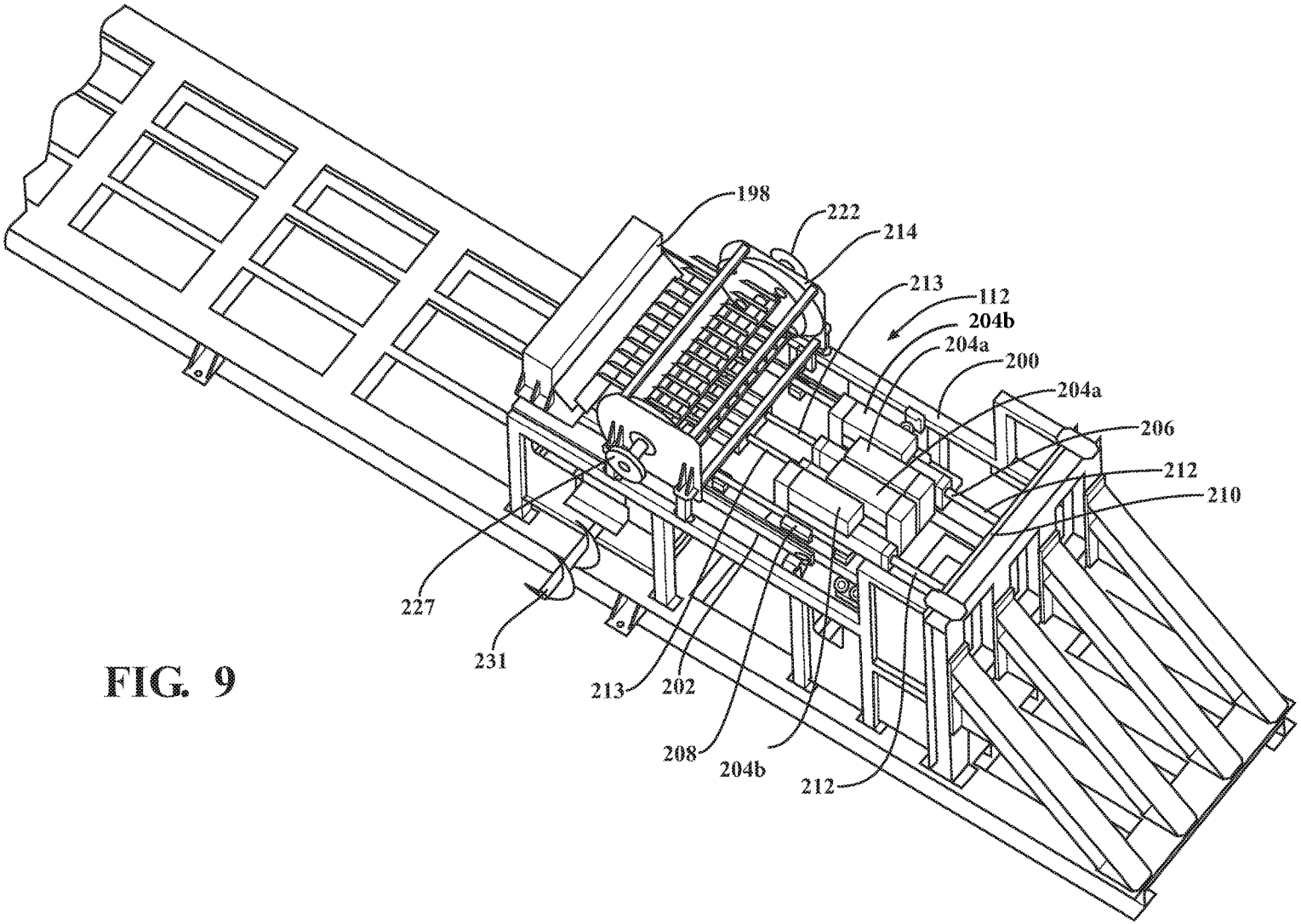
FIG. 9 is a side perspective view of the packer and the extruder of Cell 3 of the method and apparatus for manufacturing compressed structural fiberboard shown in FIG. 5.
Figure 10:
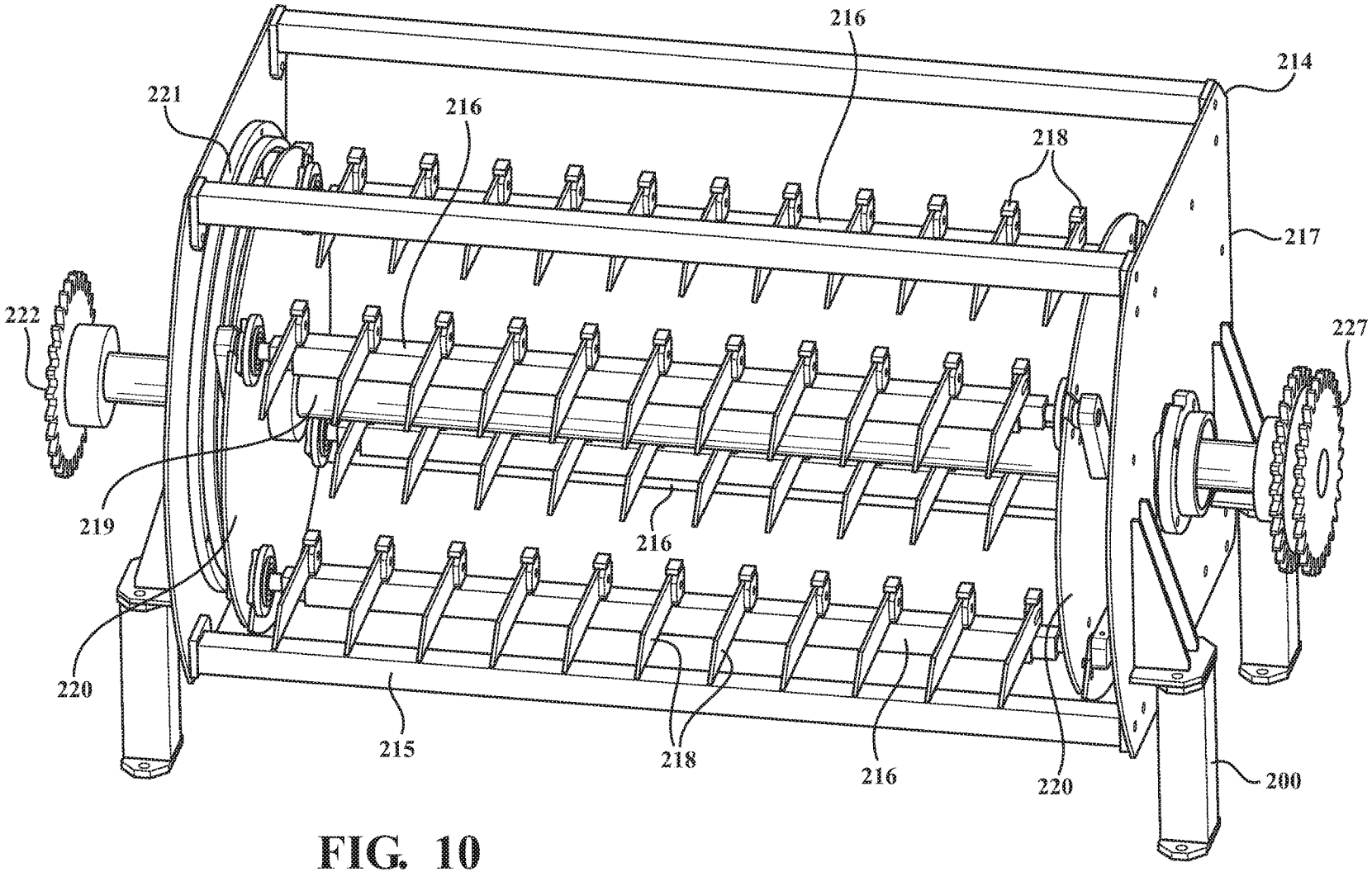
FIG. 10 is a top perspective view of the packer of Cell 3 of the method and apparatus for manufacturing compressed structural fiberboard shown in FIG. 5.

Once the rice straw 103 is properly conditioned with the appropriate amount of moisture and borax and leveled to the appropriate mat height, the rice straw 103 travels upward along the second conveyor 146 towards the hopper 110 in Cell 3, as shown in FIGS. 5-7. At the end of the second conveyor 146, the rice straw 103 is engaged by the rotating fingers 166 on the rotating shaft 164 and thrown against a cover or hood 174 of the hopper 110 which comprises an open-sided container that directs the rice straw 103 into the hopper 110. The hopper 110 provides a frame 178 that supports a pair of substantially parallel rotatable shafts 180. Each shaft 180 has three sprockets 182 mounted thereon in an evenly spaced manner along the rotational axis of each shaft 180 wherein the three sprockets 182 on each shaft 180 are aligned to establish three pairs of the sprockets 182 between the shafts 180. A continuous sprocket chain 184 or belt extends around each pair of sprockets 182 such that when one shaft 180 is rotatably driven, the sprocket chains 184 drive the other of the two shafts 180. The sprocket chains 184 have a plurality of elongated mounting plates 186 that extend across all three sprocket chains 184 substantially parallel to the shafts 180. The mounting plates 186 are connected to the outside surface of the sprocket chains 184 so as not to affect the sprocket chains 184 from engaging and driving the sprockets 182. The mounting plates 186 are evenly spaced about the sprocket chains 184. Each mounting plate 186 has a plurality of elongated fingers or rods 188 that extend outward away from the mounting plates 186 and the sprockets 182. One of the shafts 180 has a driven sprocket 189 attached to an end of the shaft 180 wherein a driving sprocket 190 is mounted to the frame 178. A belt or chain (not shown) connects the driving sprocket 190 to the driven sprocket 189. A variable speed drive 192 is mounted to the frame 178 and connected to the driving sprocket 190 for rotating the driving sprocket 190. This, in turn, drives the driven sprocket 189 which in turn rotates the sprockets 182, the sprocket chains 184, the mounting plates 186, and the rods 188 of the hopper 110. The variable drive 192 is controlled by the control system 256 which allows for precise control of the speed of the hopper 110 thereby controlling the speed and volume at which the rice straw 103 is fed into a chute 194 of the hopper 110. The chute 194 is a rectangular enclosure having open ends wherein one end 195 is connected to one end of the hopper cover 174. The opposite end of the chute 194 has an adjustable opening for adjusting the size of the exit opening thereby controlling the amount of the rice straw 103 that exits the hopper 110. Thus, as the rice straw 103 enters the hopper 110, the rice straw 103 is thrown against the hopper cover 174 by the fingers 166 at the end of the second conveyor 146 and falls into the hopper 110. The fingers or rods 188 of the hopper 110 engage and move the rice straw 103 into the chute 194 where the rice straw 103 is compacted and dispersed from the chute 194 in a substantially rectangular mat.

To form a compacted rice straw core 197 for the compressed structural fiberboard 101, a continuous extrusion process is utilized that relies on heat and pressure to form the compacted rice straw core 197 of the compressed structural fiberboard 101. The extruder 112 may provide a linear cyclic ram or chevron 196 that compacts the rice straw 103 into an extrusion tunnel 198, as shown in FIGS. 5 and 8-10. The cyclic ram 196 reciprocally moves linearly between a withdrawn or retracted position, wherein the extrusion tunnel 198 is open and additional rice straw 103 may be fed into the extrusion tunnel 198 by a packer 214, and an extended or compact position, wherein the cyclic ram 196 closes the extrusion tunnel 198 and compacts and extrudes the rice straw 103 into a continuous compressed structural fiberboard 101.

To supply the extruder 112 with rice straw 103, the packer 214 has a frame 217 mounted to a support structure 200 and positioned directly above the extrusion tunnel 198 and directly below the chute 194 of the hopper 110. The packer 214 has a cage-like cylinder 215 with a rotational shaft 219 and two circular end plates 221 mounted on the ends of the rotational shaft 219. Four rods 216 are radially spaced and extend substantially parallel to the rotational shaft 219. Each rod 216 has a plurality of feeder blades 218 that are connected to and extend outward from the rods 216. The rods 216 are mounted to a pair of circular plates 220 that are located adjacent to and axially off-set from the end plates 221 at the ends of the cylinder 215 while also being connected to the rotational shaft 219. Slots are provided in the end plates 221 of the cylinder 215 to allow the rods 216 to move radially relative to the end plates 221 of the cylinder 215. This movement creates a camming effect with the rods 216 and the feeder blades 218 of the packer 214 as the rotational shaft 219 rotates. The packer 214 rotates in unison with the cyclic ram 196 such that when the cyclic ram 196 is in the retracted position, and the extrusion tunnel 198 is open, the packer 214 cams forward and rotates downward thereby engaging and forcing the rice straw 103 from the chute 194 to the extrusion tunnel 198 via the feeder blades 218. When the cyclic ram 196 is in the extended or compact position, the extrusion tunnel 198 is closed, and the packer 214 cams rearwardly thereby avoiding the feeder blades 218 from engaging the rice straw from the chute 194. The rotational shaft 219 may have a sprocket 222 mounted on the end thereof wherein a belt or chain (not shown) connects the sprocket 222 to a sprocket 224 of a variable drive 226 mounted on the underside of the support structure 200. A second sprocket 227 may be mounted to the opposite end of the rotational shaft 219 wherein a belt or chain (not shown) may be connected to a sprocket (not shown) of a worm gear 231 which is located under the extruder 112 to remove any fallen rice straw from underneath the extruder 112. The variable drive 226 is in communication with and controlled by the control system 256 such that the speed of the variable drive 226 and the packer 214 may be increased to provide a greater volume of rice straw 103 to the extruder 112 or decreased to reduce the volume of rice straw 103 to the extruder 112, as will be described later in the present disclosure.

The cyclic ram 196 is supported by the support structure 200, wherein the cyclic ram 196 is slidably supported by a pair of substantially parallel, sliding guide rails 202 connected to the support structure 200. The cyclic ram 196 is reciprocally driven along the guide rails 202 by four electric linear actuators 204*a*, 204*b*. The linear actuators 204*a*, 204*b* are adjacently mounted on a table or floating plate 206 immediately above the cyclic ram 196 wherein the table 206 is supported by a pair of substantially parallel, sliding guide rails 208 on the cyclic ram 196 such that the table 206 and the linear actuators 204*a*, 204*b* can move linearly relative to the cyclic ram 196. The four linear actuators 204*a*, 204*b* are positioned in pairs of two wherein the linear actuators 204*a* are mounted immediately adjacent one another in the center of the table 206, and the linear actuators 204*b* are mounted on opposite sides of the linear actuators 204*a*. Two of the linear actuators 204*b* each have a piston rod 212 connected to the back wall 210 of the support structure 200 while the other two linear actuators 204*a* each have a piston rod 213 connected to the cyclic ram 196. The piston rods 212, 213 move linearly and reciprocally in and out of the respective linear actuators 204*a*, 204*b* between a retracted position and an extended position at a speed of 60 strokes per minute with a stroke length of approximately 30"-32". When the cyclic ram 196 is in the retracted position, all four linear actuators 204*a*, 204*b* are in the retracted position, that is, their associated piston rods 216 are fully withdrawn into the linear actuators 204*a*, 204*b*. When this occurs, the table 206 supporting the linear actuators 204*a*, 204*b* is adjacent the back wall 210 of the support structure 200, and the cyclic ram 196 is positioned in its most rearward position toward the back wall 210 of the support structure 200. When the cycle of the cyclic ram 196 begins, the two linear actuators 204*a* are simultaneously actuated by power servos (not shown) under the control of motion control software in the control system 256 such that the piston rods 213 extend outward from the linear actuators 204*a* thereby moving the cyclic ram 196 away from the back wall 210 toward the extrusion tunnel 198. Shortly thereafter, the two linear actuators 204*b* are simultaneously actuated by power servos (not shown) also under the control of motion control software in the control system 256 such that the piston rods 212 of the linear actuators 204*b* move the table 206 toward the extrusion tunnel 198 and away from the back wall 210 of the support structure 200. During this time, both pairs of linear actuators 204*a*, 204*b* are actuated concurrently such that their respective piston rods 213, 212 move simultaneously to provide maximum pressure on the rice straw 103 in the throat of extrusion tunnel 198. Once the piston rods 212 of the linear actuators 204*b* become fully extended, the table 206 is stopped from moving toward the extrusion tunnel 198, and the piston rods 213 of the linear actuators 204*a* continue to extend the cyclic ram 196 into the extrusion tunnel 198 and into the extended position thereby completing the compression cycle. The cycle then reverses itself, and the process continually cycles. The use of the linear actuators 204*a*, 204*b* to drive the cyclic ram 196 provides greater control of the time and force of the cyclic ram 196 during the compression cycle as compared to other conventional extruders. In addition, the linear actuators 204*a*, 204*b* require less energy, less cost, less maintenance, and reduced safety risk than other conventional extruders, especially those using rotating equipment. As previously noted, the linear actuators 204*a*, 204*b* are in communication with and controlled by motion control software in the control system 256 such that the stroking speed and timing of the linear actuators 204*a*, 204*b* can be adjusted relative to the speed of the mill 102.

Figure 20:
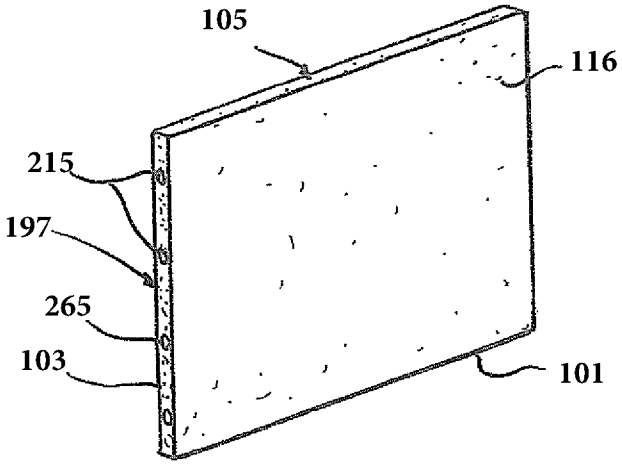
FIG. 20 is a perspective view of the compressed structural fiberboard produced by the method and apparatus for manufacturing the compressed structural fiberboard.

When the cyclic ram 196 cycles forward to compact and extrude the rice straw 103, a continuous compacted and extruded structural fiberboard 101 emerges from the back end of the extruder 112. With each forward stroke of the cyclic ram 196, the continuous structural fiberboard 101 moves 2" linearly outward away from the back end of the extruder 112, and the rice straw 103 is compacted and pushed further forward thereby forming the compacted rice straw core 197 and taking on the shape of the extrusion tunnel 198. The extrusion tunnel 198 has a substantially rectangular configuration that is substantially 3.5" high by 48" wide, which is the desired shape and size of the compressed structural fiberboard 101. The shape and size of the extrusion tunnel 198 may be adjusted in a conventional manner so that the size and shape of the compressed structural fiberboard 101 can be adjusted. The front of the cyclic ram 196 may include a plurality of pointed projections (not shown) which form holes 265 through the compacted rice straw core 197 in the end of the compressed structural fiberboard 101, as seen in FIG. 20. These holes 265 register with holes 265 in the previously compacted rice straw core 197 making up the compacted rice straw core 197 of the compressed structural fiberboard 101 to provide holes 265 extending the length of the compressed structural fiberboard 101. The holes 265 are provided in the center of the compressed structural fiberboard 101 for use as raceways, for example, for electrical wiring or plumbing. The holes 265 may also be used during the formation of the compressed structural fiberboard 101 to introduce fluid, such as heated air, to the center of the compressed structural fiberboard 101. The number of these projections can vary, depending on the number of holes 265 desired in the compressed structural fiberboard 101.

In order to bind the extruded compressed structural fiberboard 101, it is necessary to heat the compressed structural fiberboard 101. Typical agricultural fiber, such as rice straw 103, is comprised of a bundle of cellulose strands or fibers that are held together by a natural binder or adhesive called lignin. Lignin behaves much like a conventional thermoplastic, wherein the lignin softens when heated and hardens when cooled. This allows the fibers of the rice straw 103 to essentially be shaped into a particular configuration when heated and cooled.

Figure 11:
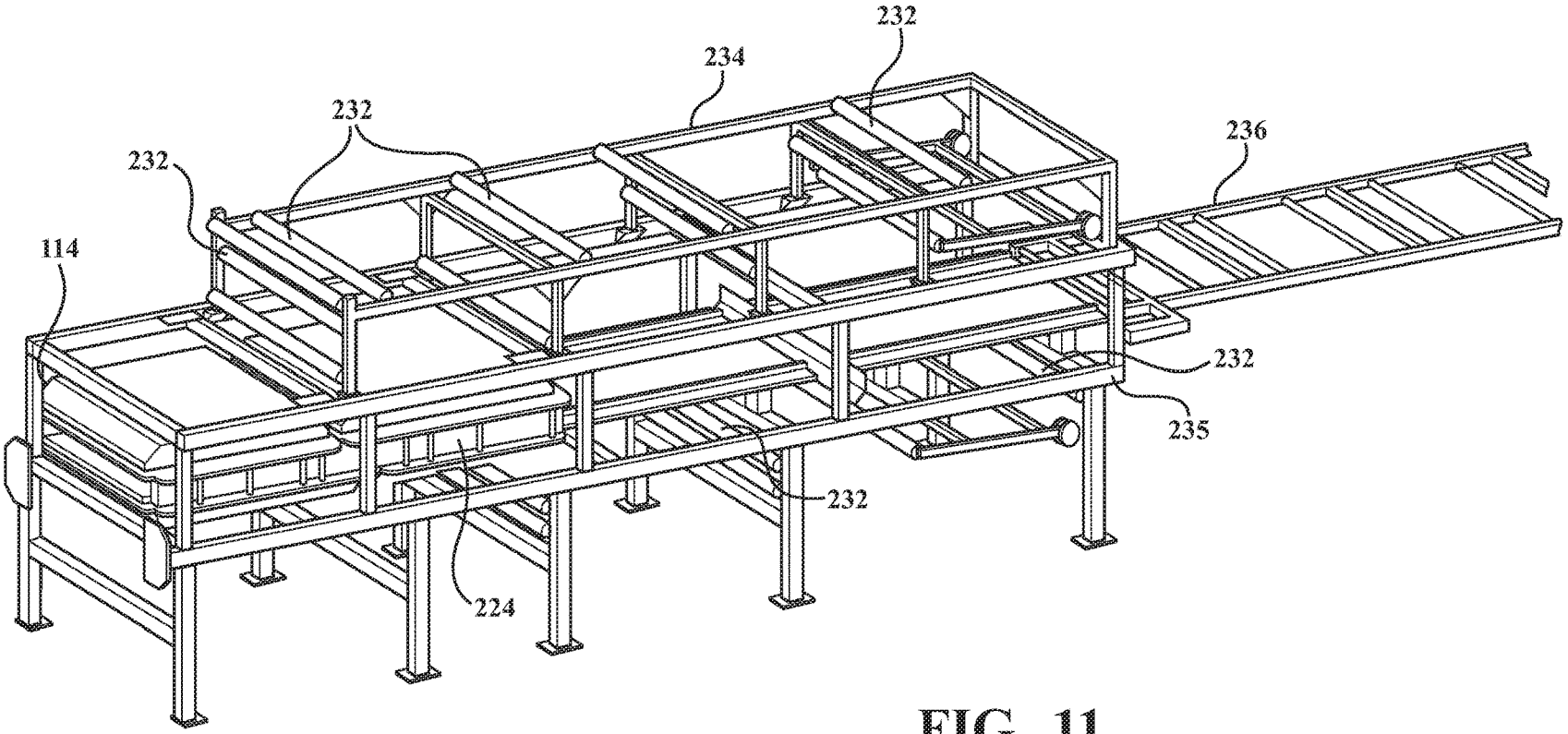
FIG. 11 is a perspective view of ovens and paper feeders of Cell 3 of the method and apparatus for manufacturing compressed structural fiberboard shown in FIG. 5.

From the extrusion tunnel 198, the compressed structural fiberboard 101 enters the first oven 114, as shown in FIG. 11, and heats the compressed structural fiberboard 101. The introduction of the heat causes the rice straw 103 to become malleable with the steam that was introduced to the rice straw 103 earlier in the process. Steam ports (not shown) are provided in the first oven 114 to allow the steam from the compressed structural fiberboard 101 to escape the first oven 114. The moisture level within the compressed structural fiberboard 101 is important during the heating process, as the amount of moisture within the compressed structural fiberboard 101 has a direct effect on the density and firmness of the compressed structural fiberboard 101. The moisture level within the rice straw 103 prior to entering the extruder 112 is substantially 24%, and the moisture level of the rice straw 103 after exiting the first oven 114 is substantially 18%. Previous designs have utilized electric resistive heat platens to heat the compressed structural fiberboard 101; however, electric resistive heaters have been found to have a variability of 25 degrees Fahrenheit across the heat platens, to be unreliable, and to use a high amount of energy. The present disclosure utilizes synthetic oil heaters (not shown) to heat the first oven 114 in a temperature range of 360-400 degrees Fahrenheit. Synthetic oil heaters have the ability to control the temperature of a 4 ft oven to within 0.10 degrees Fahrenheit. In addition, synthetic oil heaters have been found to be more efficient and reliable than electric resistive heaters as well as requiring less start up time. The reduced variability, increased reliability, decreased use of energy, and decreased start up time of the synthetic oil heaters all assist in increasing the efficiency and process control of the mill 102 thereby providing a higher quality and more efficient compressed structural fiberboard 101 than past processes for completing the same.

Figure 12:
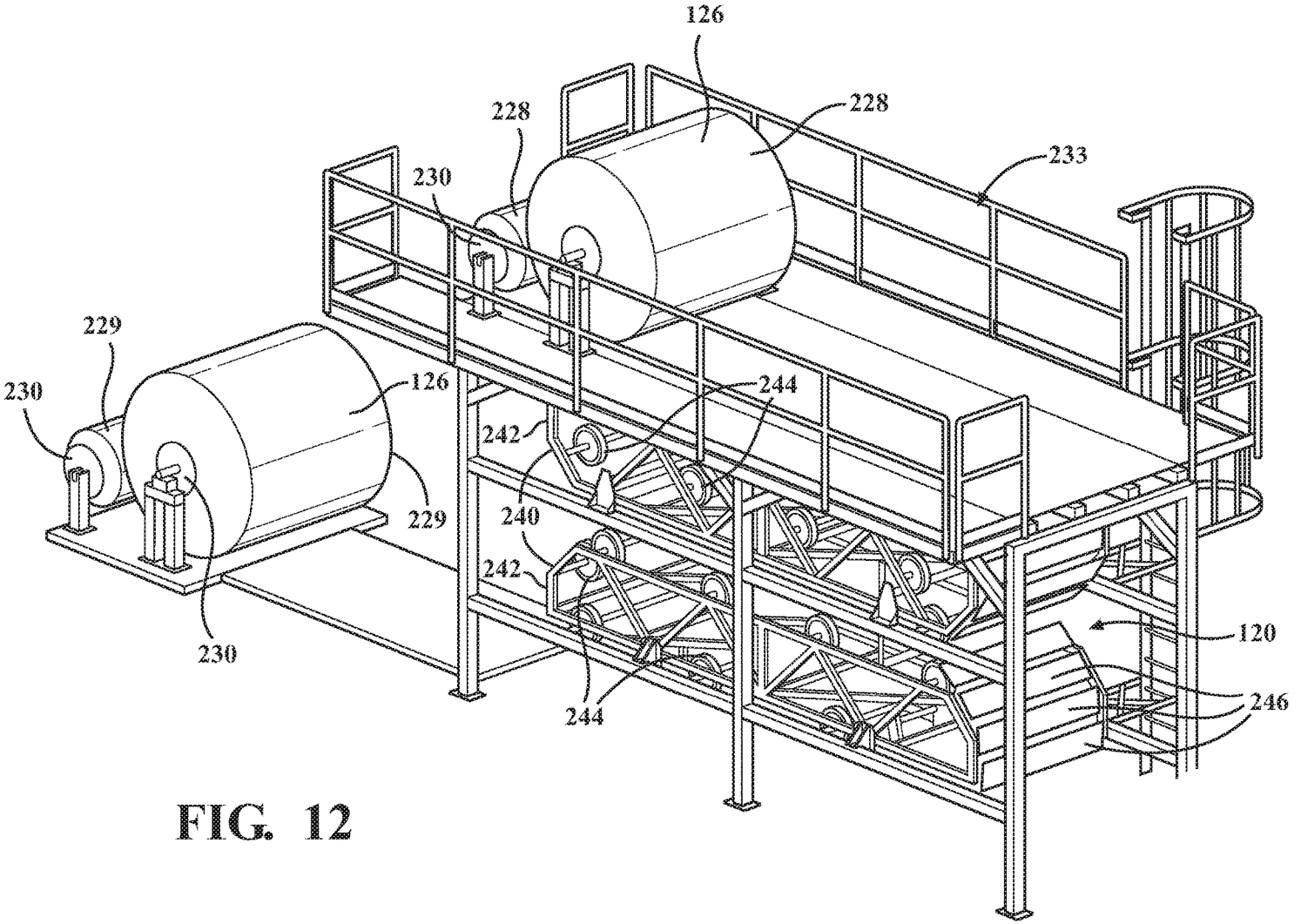
FIG. 12 is a perspective view of Cell 4 of the method and apparatus for manufacturing compressed structural fiberboard shown in FIGS. 1-2.
Figure 13:
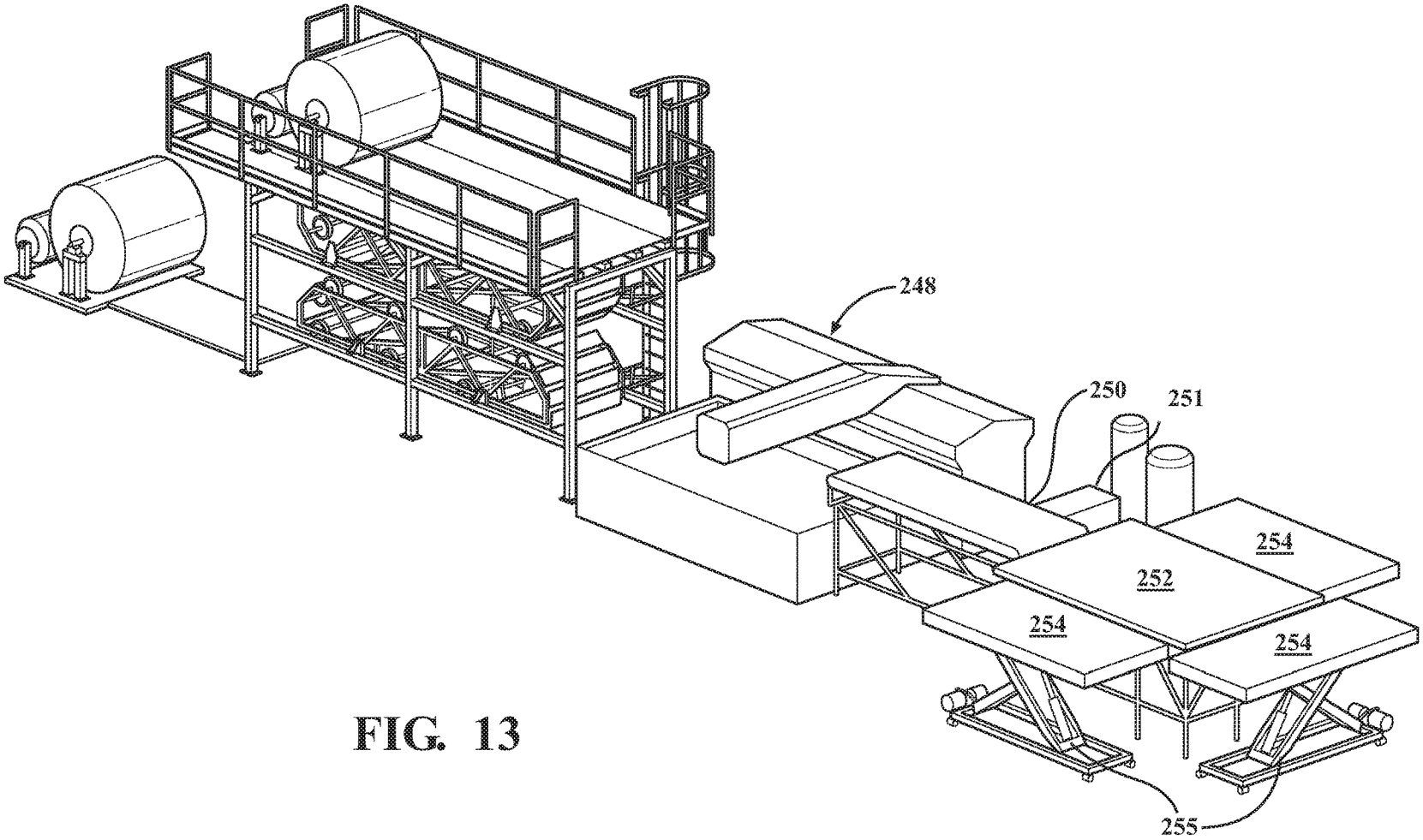
FIG. 13 is a perspective view of Cells 4-6 of the method and apparatus for manufacturing compressed structural fiberboard shown in FIGS. 1-2.

Once the compressed structural fiberboard 101 passes through the first oven 114, the continuous compressed structural fiberboard 101 immediately enters the second oven 224 adjacent the first oven 114. The second oven 224 is similar to the first oven 114 in that the second oven is a synthetic oil heater; however, the purpose of the second oven 224 is to apply the heavy-duty industrial paper 126, such as 69 lb. Kraft liner paper, to the sides of the compressed structural fiberboard 101. As shown in FIGS. 11-13. the paper 126 is continuously fed and guided from two large paper rolls 228, 229 through paper un-winders 230. The paper roll 228 provides the paper 126 to the top of the compressed structural fiberboard 101, and the paper roll 229 provides the paper 126 to the bottom side of the compressed structural fiberboard 101. The paper rolls 228 may be mounted in a support structure 233 above the mill 102 wherein the paper 126 extends across paper rollers 232 which are mounted to support structures 234 above the second oven 224 to guide and feed the paper 126 to the entrance of the second oven 224 above the compressed structural fiberboard 101. The paper roll 229 is mounted on the floor of the facility wherein paper rollers 232 are mounted under the second oven 224 and feed the paper 126 to the entrance of the second oven 224 on the underside of the compressed structural fiberboard 101 through paper rollers 232 supported by a support structure 235 under the second oven 224. In another embodiment, the paper rolls 228, 229 may be mounted to the sides of the mill 102, as shown in FIG. 5. As the paper 126 reaches the entrance of the second oven 224, the paper rollers 232 direct the paper 126 into the second oven 224 onto the top and bottom sides of the compressed structural fiberboard 101 such that the paper 126 is heading back towards the paper rollers 232 and the paper rolls 228, 229. The inner side of the paper 126 facing the compressed structural fiberboard 101 is coated with a dry glue (not shown) that is activated by the heat in the second oven 224 such that when the dry glue is activated on the paper 126, the paper 126 adheres to the compressed structural fiberboard 101. The top and bottom sides of the compressed structural fiberboard 101 are coated with the paper 126, and the paper 126 is folded over the sides of the compressed structural fiberboard 101 through side blocks (not shown) in the second oven 224 so as to enclose the paper 126 on the compressed structural fiberboard 101 except for the ends of the compressed structural fiberboard 101. As the compressed structural fiberboard 101 exits the second oven 224 fully wrapped, except for the ends of the compressed structural fiberboard 101, the compressed structural fiberboard 101 continues to move forward through the mill 102 due to the extruder 112 incrementally pushing the continuous compressed structural fiberboard 101 forward. The compressed structural fiberboard 101 is further carried on a roller conveyor 236 to the heat sink track cooler 120 in Cell 4.

When the compressed structural fiberboard 101 exits the second oven 224, the temperature of the compressed structural fiberboard 101 is at substantially 160 degrees Fahrenheit. Such high temperatures of the compressed structural fiberboard 101 must be reduced quickly in order to handle the compressed structural fiberboard 101. Previous known methods of cooling the compressed structural fiberboard 101 include refrigerated cooling fans and cold-water chilling systems which are both inefficient and costly. The present disclosure utilizes the heat sink track cooler 120 to provide an aluminum track passive heat sink cooling system that utilizes aluminum plates or panels 246 to draw the heat out from the compressed structural fiberboard 101, as shown in FIG. 12. The heat sink track cooler 120 includes a pair of continuous oval tracks 240 that oppose one another such that the compressed structural fiberboard 101 is fed through between the tracks 240. Each track 240 has a substantially oval frame 242 with rollers 244 mounted along the outer edges of the frame 242. The continuous tracks 240 extend over the rollers 244 wherein the tracks 240 are configured of aluminum plates or panels 246. The continuous tracks 240 roll over the rollers 244 and are driven by a variable speed drive (not shown). The variable speed drive is controlled by and in communication with the control system 256 of the mill 102 such that the speed at which the tracks 240 rotate can be adjusted based on the speed at which the compressed structural fiberboard 101 is being produced. As the compressed structural board 101 extends between the continuous tracks 240, the compressed structural board 101 is pulled through the continuous tracks 240, thereby allowing the aluminum plates 246 to engage the sides of the compressed structural fiberboard 101. When the aluminum plates 246 are in contact with the compressed structural fiberboard 101, heat is transferred from the compressed structural board 101 to the aluminum plates 246 due to the heat transfer qualities provided in aluminum. This process reduces the temperature of the compressed structural board 101 by substantially 50 degrees Fahrenheit such that the temperature of the compressed structural fiberboard 101 after passing through the cooling system 238 is substantially 105 degrees Fahrenheit.

The heat sink track coolers 120 provide numerous advantages over the previously known cooling systems. For instance, the heat sink track cooler 120 provides a more consistent and controllable method of controlling the temperature of the compressed structural fiberboards 101 exiting the ovens 114, 224 as compared to previously known water-cooling systems and electric fans. In addition, the heat sink track coolers 120 require less energy, less external equipment, and less floor space, thereby reducing the costs and maintenance of previously known cooling systems. In addition, the rollers 244 and tracks 240 of the heat sink track coolers 120 slightly resist forward movement of the compressed structural fiberboard 101 thereby creating back pressure on the extruder 112. This back pressure can be controlled by minutely controlling the speed at which the tracks 240 rotate and at which the heat sink track coolers 120 pull the compressed structural fiberboard 101 through the tracks 240 thereby controlling the density of the compressed structural fiberboard 101 from the extruder 112 and eliminating any surging of the compressed structural fiberboard 101 created by the extruder 112. The variable speed drive of the heat sink track cooler 120 is controlled by the control system 256 of the mill 102 so as to control the speed at which the compressed structural fiberboard 101 is pulled through the heat sink track cooler 120. By increasing the speed of the variable drives, the density of the compressed structural fiberboard 101 may be decreased, and by decreasing the speed of the variable drive, the density of the compressed structural board 101 may be increased. By continuously monitoring the density of the compressed structural fiberboard 101, the variable drive of the heat sink track cooler 120 can be continuously adjusted and monitored by the control system 256 of the mill 102.

As the compressed structural board 101 exits the heat sink track cooler 120, the compressed structural fiberboard 101 moves toward and into a water jet cutting system 248 in Cell 5, as shown in FIG. 13. The water jet cutting system 248 monitors and measures the length of the compressed structural fiberboard 101 and determines where to cut the compressed structural fiberboard 101. Once the water jet cutting system 248 determines where to cut the compressed structural fiberboard 101, a moving clamp (not shown) and water jet (not shown) engage and clamp the compressed structural fiberboard 101 while moving linearly with the compressed structural fiberboard 101. The water jet is then engaged and moves substantially perpendicular to the path of travel of the compressed structural fiberboard 101 while cutting the compressed structural fiberboard 101. Once the compressed structural fiberboard 101 is cut into an individual and separate boards, the individual compressed structural fiberboards 101 move onto a conveyor 250 where the individual compressed structural fiberboards 101 move toward and into Cell 6.

The water jet cutting system 248 provides numerous advantages over the previously known mechanical saws. For instance, the water jet cutting system 248 does not generate saw dust, and thus, there is no need to collect the saw dust nor are there any environmental concerns created by the lack of saw dust. In addition, the accuracy of the water jet cutting system 248 is far greater than mechanical saws, as the accuracy of the water jet cutting system 248 is within 0.001". The water jet cutting system 248 is also cheaper to operate and maintain, as there are no mechanical saw blades to be replaced. Based on these advantages, it is evident that the water jet cutting system 248 increases the efficiency of the process and the quality of the compressed structural fiberboard 101 by creating more accurate lengths of the compressed structural fiberboard 101, reducing the capital cost and maintenance cost of the cutting process, and providing a cleaner and safer process than previously known processes.

To weigh and cap the ends of the individual compressed structural fiberboard 101, the compressed structural fiberboard 101 may be weighed and measured by electronic scales 251 on the conveyor 250. The weight of the compressed structural fiberboard 101 may be used to determine the density and evaluate the quality of the compressed structural fiberboard 101. The electronic scales 251 are in communication with the control system 256 such that the information regarding the weight and density are entered into the control system 256 to determine if any adjustments in the mill 102 must be made. The compressed structural fiberboard 101 is then moved to the air table 252 provided in Cell 6. The height of the air table 252 is pneumatically controlled and provides a quicker and ergonomically easier way for workers to handle the heavy compressed structural fiberboards 101. While on the air table 252, the ends of the compressed structural fiberboard 101 are manually capped with the Kraft paper 116 by gluing the Kraft paper 116 onto both ends of the compressed structural fiberboard 101. On three sides of the air table 252, side tables 254 supported by finger scissor lifts 255 are provided to unload the compressed structural boards 101 from the air table 252. The finger scissor lifts 255 of the side tables 254 allow for the side tables 254 to adjust to the same height as the air table 252 regardless of how many of the compressed structural boards 101 are loaded onto the side tables 254. The compressed structural boards 101 may then be unloaded from the side tables 254 by fork lift trucks (not shown) or other unloading devices.

Figure 14:
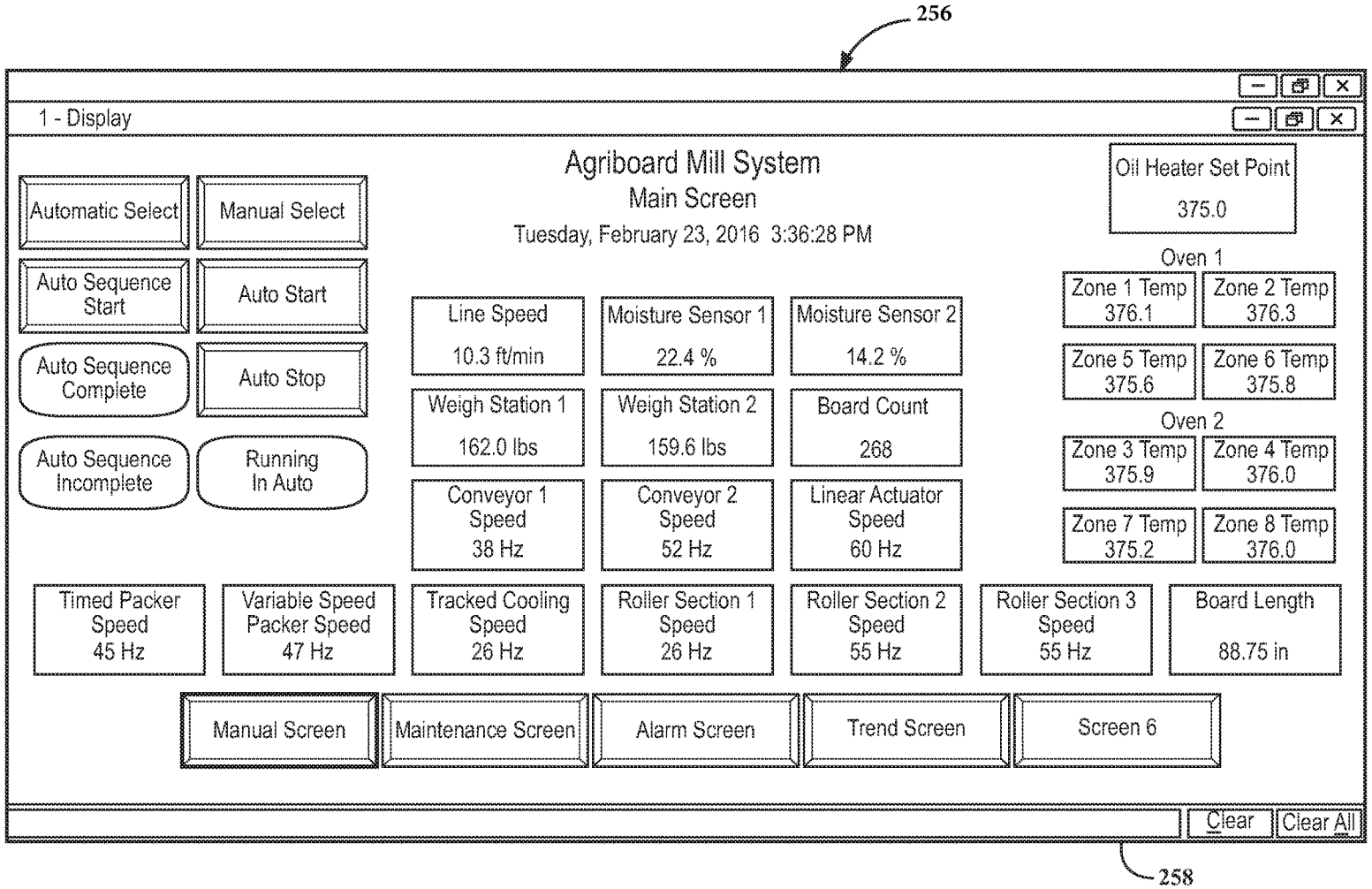
FIG. 14 is a main computer screen image of a control system of the method and apparatus for manufacturing compressed structural fiberboard.
Figure 15:
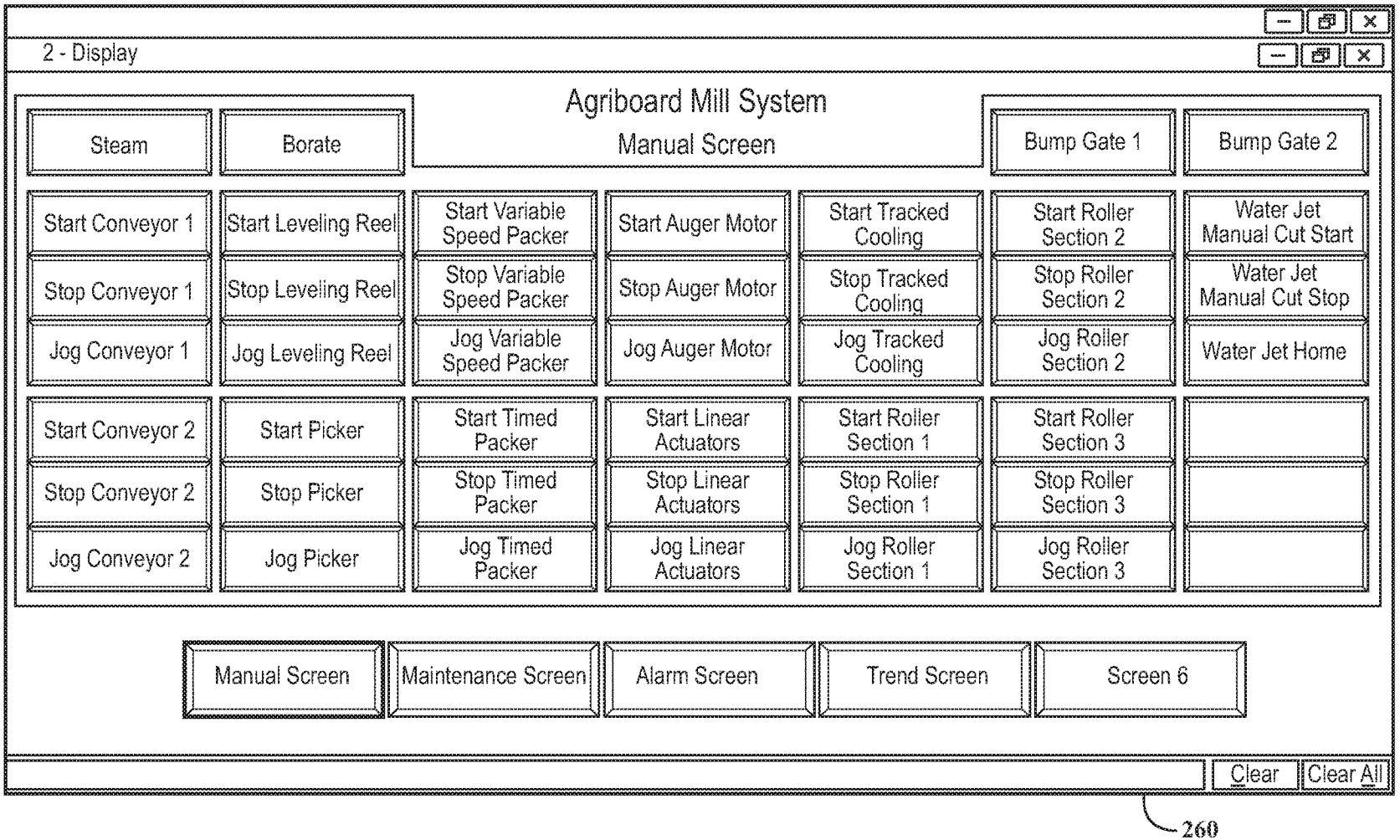
FIG. 15 is a manual computer screen image of the control system of the method and apparatus for manufacturing compressed structural fiberboard.
Figure 16:
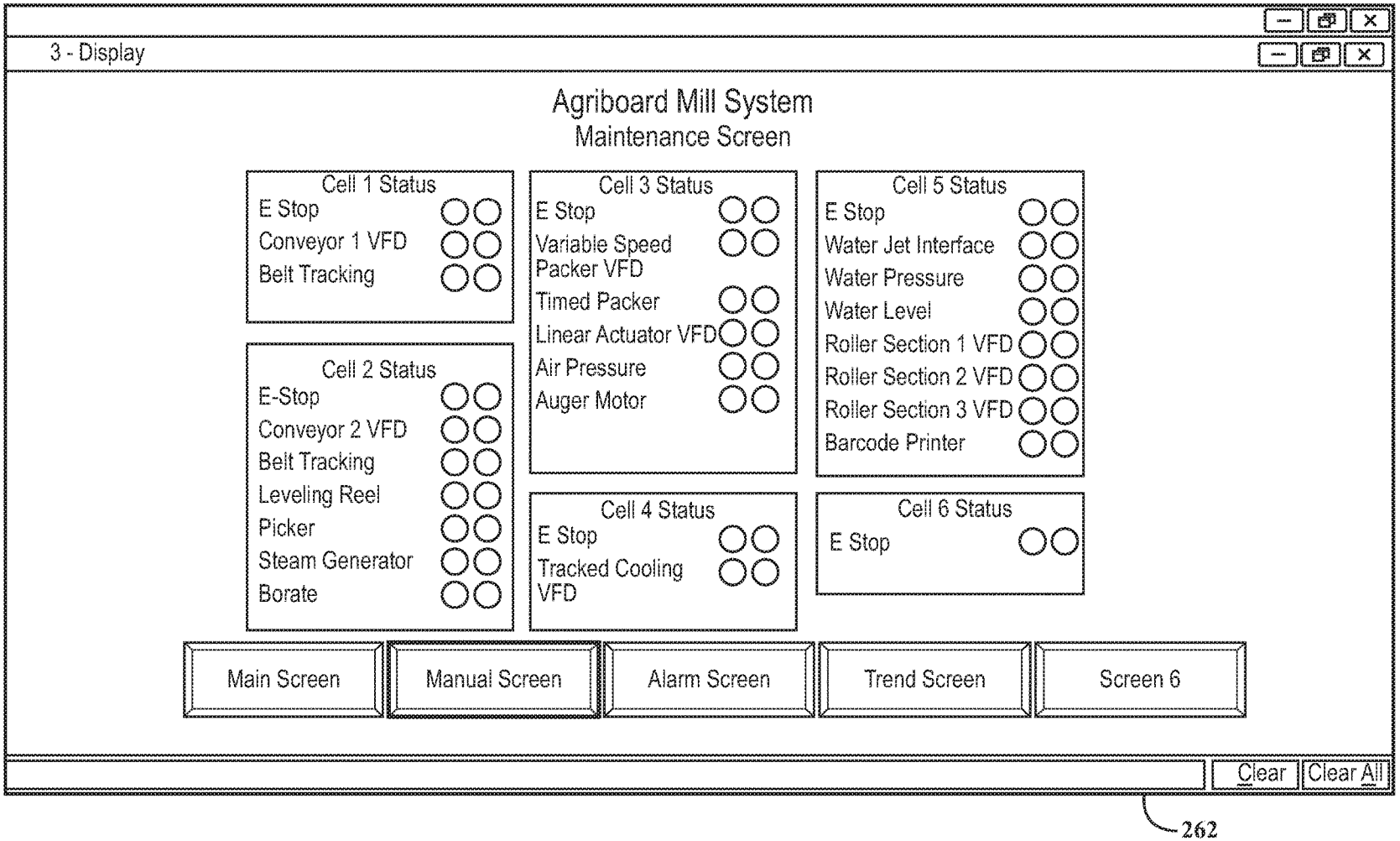
FIG. 16 is a maintenance computer screen image of the control system of the method and apparatus for manufacturing compressed structural fiberboard.
Figure 17:
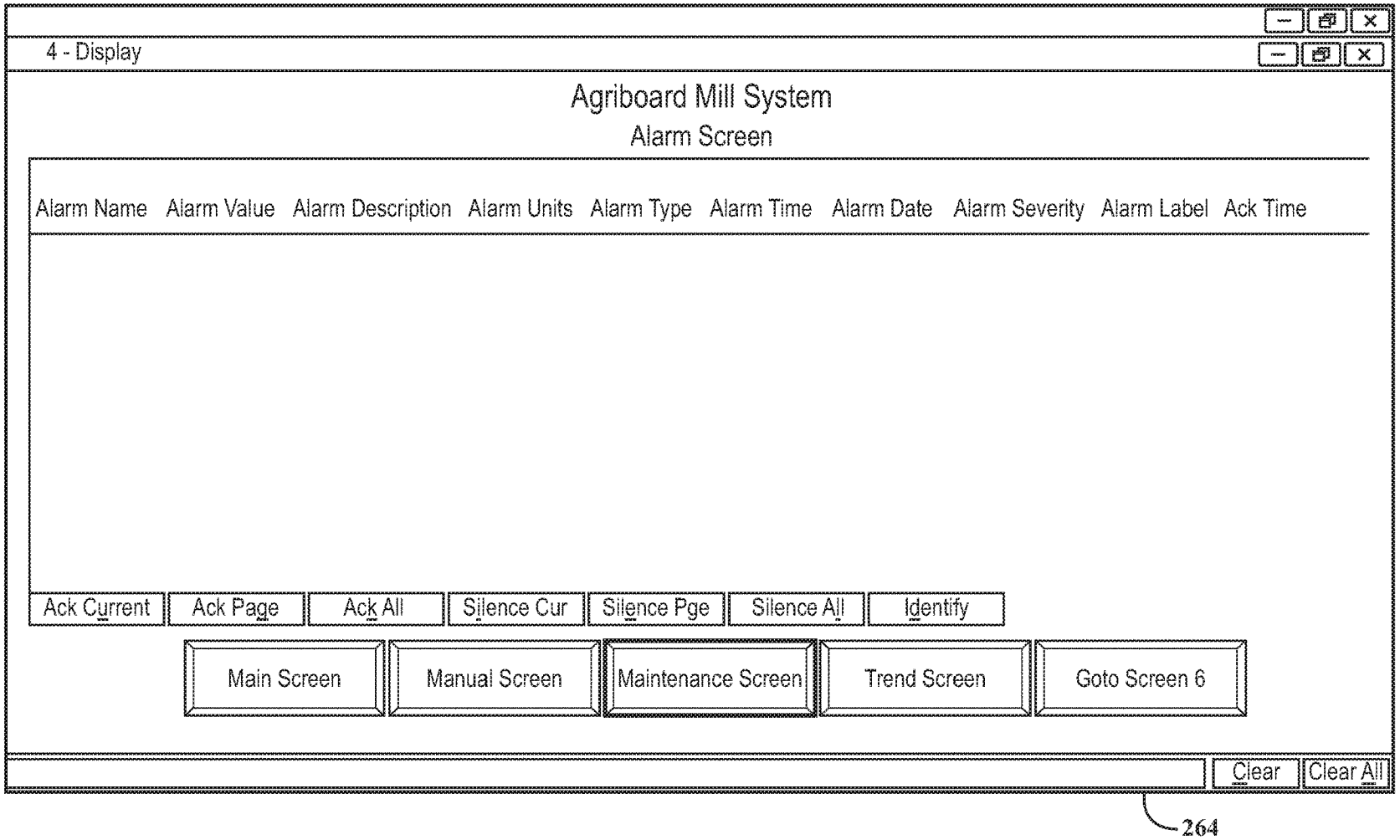
FIG. 17 is an alarm computer screen image of the control system of the method and apparatus for manufacturing compressed structural fiberboard.
Figure 18:
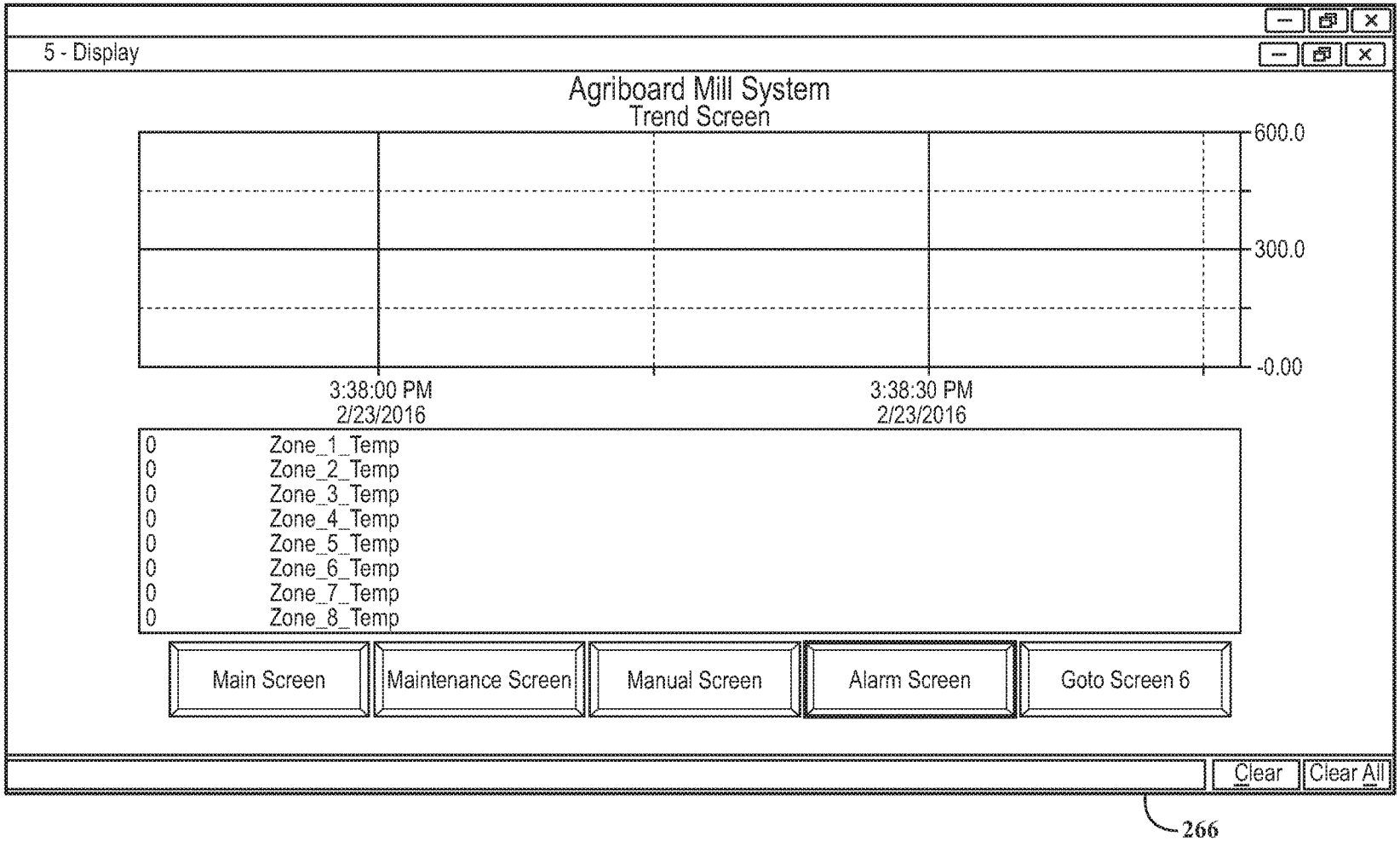
FIG. 18 is a trend computer screen image of the control system of the method and apparatus for manufacturing compressed structural fiberboard.
Figure 19:
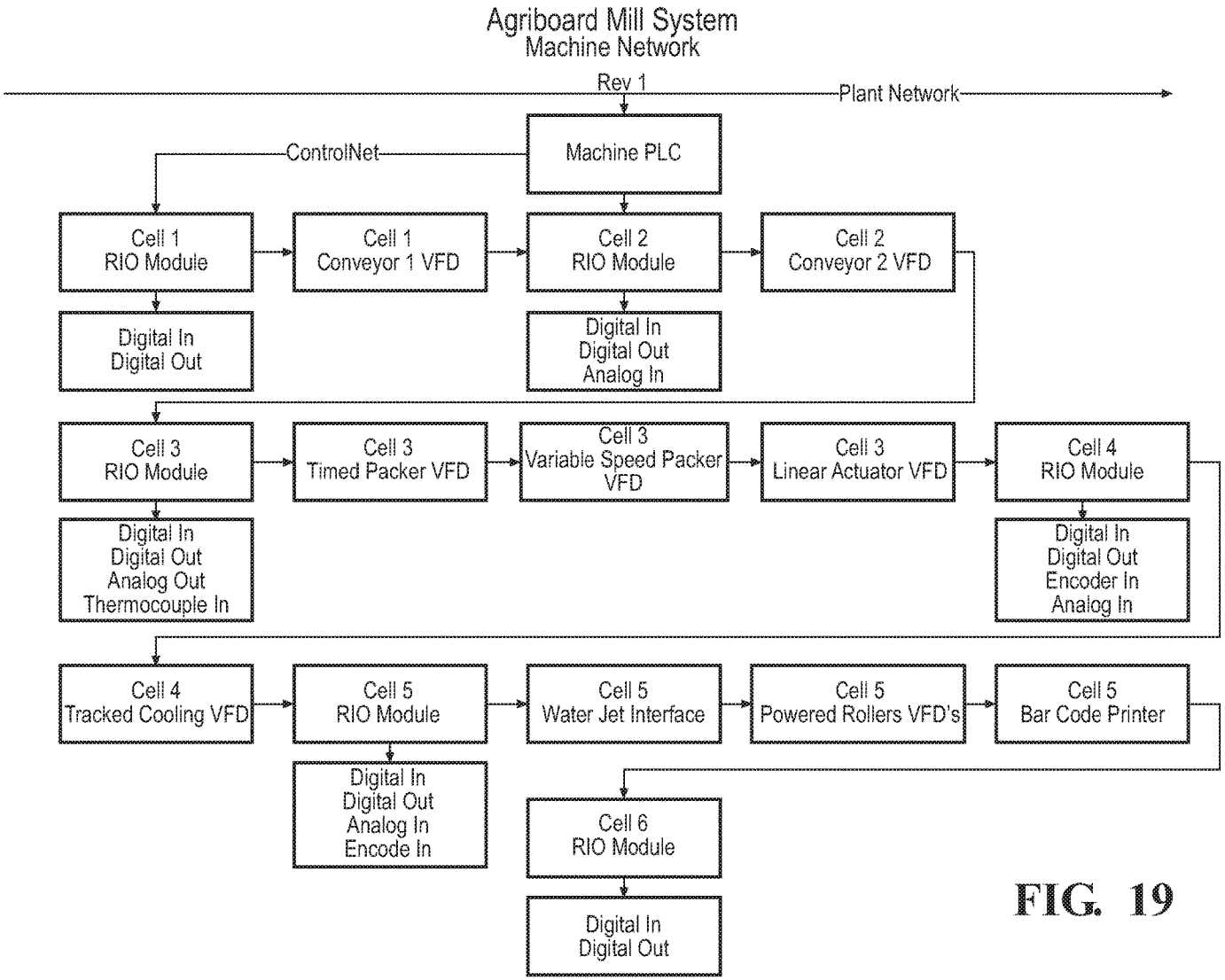
FIG. 19 is a schematic diagram of a machine network of the control system of the method and apparatus for manufacturing compressed structural fiberboard.

In order to increase the efficiency of the operation of the mill 102 and the quality of the compressed structural fiberboard 101, the complete computerized control processing system 256 is provided in the method and apparatus 100. The control processing system 256 includes monitoring and controlling of all the previously cited elements of the mill 102, including but not limited to the variable speed drives, linear actuators, ovens, electronic scales, etc., so as to properly adjust and control all aspects of the method and apparatus 100. As seen in FIGS. 14-19, a main computer screen 258 is provided for monitoring all aspects of the method and apparatus 100. For instance, as shown in FIG. 14, the main computer screen 258 of the control processing system 256 monitors and controls various parameters of the mill 102, such as line speed, moisture levels of the rice straw 103, weight and length of the compressed structural fiberboard 101, count of the finished compressed structural fiberboards 101, conveyor speed, linear actuator speed of the extruder 112, speed of the packer 214, speed of the heat sink track coolers 120, temperature of the ovens 114, 224, etc. A second computer screen 260 shown in FIG. 15 provides manual control of many of the processes and equipment monitored in the main computer screen 258. A maintenance computer screen 262 shown in FIG. 16 allows for the monitoring of the status of all of the monitored processes and equipment in each of Cells 1-6. An alarm computer screen 264 as shown in FIG. 17 indicates the status of all alarms on the mill 102. Lastly, a trend computer screen 266 as shown in FIG. 18 indicates all of the process trends of the manufacturing process provided on the mill 102. As shown in FIG. 19, the control processing system 256 communicates and ties Cells 1-6 through a machine programmable logic controller 268 that can communicate and control Cells 1-6 based on the parameters of the equipment and processes monitored during the manufacturing process.

In use, the method and apparatus 100 of the present disclosure begins by delivering bales of rice straw 103 to Cell 1 at the end of the mill 102. The rice straw 103 is manually pulled and separated from bales of rice straw 103 and placed on the conveyor 104 of Cell 1. The conveyor 104 conveys the rice straw 103 to the beginning of the conveyor 146 in Cell 2, wherein the rice straw 103 passes through the enclosure 168 and is leveled by the leveling reel 170, and steam and borax are applied to the rice straw 103. The rice straw 103 then travels up the conveyor 146 to the hopper 110 in Cell 3 where the rice straw 103 is thrown against the hopper cover 174 by the fingers 166 at the end of the conveyor 146. The rice straw 103 is driven into the chute 194 by the hopper 110 where the packer 214 pulls the rice straw 103 from the chute 194 through the use of the feeder blades 218 and feeds the rice straw 103 into the extruder 112. The rice straw 103 is compacted and extruded by the extruder 112 to form the continuous compressed structural fiberboard 101. The compressed structural fiberboard 101 travels from the extruder 112 to the first oven 114 where the lignin in the rice straw 103 is softened to allow the straw fibers to relax and stick together to form the compressed structural fiberboard 101. The compressed structural fiberboard 101 travels from the first oven 114 to the second oven 224 where the Kraft paper 126 covers the top, bottom, and sides of the compressed structural fiberboard 101, and the glue on the Kraft paper 126 is activated by the heat of the second oven 224 to allow the Kraft paper 126 to adhere to the compressed structural fiberboard 101. The compressed structural fiberboard 101 travels to the heat sink track cooler 120 of Cell 4 where the aluminum panels 246 engage the compressed structural fiberboard 101 to reduce the temperature of the compressed structural fiberboard 101. The compressed structural fiberboard 101 then travels to Cell 5 where the continuous compressed structural fiberboard 101 is cut into individual and separate boards by the water jet cutting system 248. The individual compressed structural fiberboards 101 are conveyed to the air table 252 where the Kraft paper 126 is manually glued to the ends of the compressed structural fiberboards 101. The individual compressed structural fiberboards 101 are weighed, measured, and moved to the side tables 254, where the compressed structural fiberboards 101 are transported from the mill 102. All of the equipment and processes are electronically monitored and communicate with the computerized control system 256 that allows continual monitoring and adjustment of the equipment and processes for producing the compressed structural fiberboard 101. The overall production rate of the compressed structural fiberboard 101 is 10 ft/min. which is twice the rate as previously known systems with a mass flow rate of 10,500 lbs./hr. of rice straw 103. The disclosed method and apparatus 100 provides numerous advantages over existing processes by improving the quality of the compressed structural fiberboard 101, reducing the scrap rate, creating higher production rates, increasing process controls, creating a simpler and easier method to operate and control the process, increasing the ability to identify and correct errors in the process, reducing the level of energy utilized, and reducing the capital costs in constructing the mill 102.

While the disclosure has been made in connection with what is presently considered to be the most practical and preferred embodiment, it should be understood that the disclosure is intended to cover various modifications and equivalent arrangements.

What is claimed is:

1. An efficient method for making a compressed structural fiberboard from agricultural fibrous matter, comprising the steps of:

providing a preselected volume of the agricultural fibrous matter;

preconditioning the agricultural fibrous matter to have first predetermined moisture level within the agricultural fibrous matter;

extruding the agricultural fibrous matter to form a continuous compressed structural fiberboard using an extruder having a cyclic ram that is actuated and driven by electric linear actuators;

monitoring the density of the compressed structural fiberboard; and utilizing a programmable logic controller to monitor and adjust the speed at which the compressed structural board is produced to control the density of the compressed structural fiberboard.

2. The method for making a compressed structural fiberboard as stated in claim 1, the steps further comprising:

heating the continuous compressed structural fiberboard with synthetic oil heaters after the step of extruding the agricultural fibrous matter to activate lignin in the agricultural fibrous matter.

3. The method for making a compressed structural fiberboard as stated in claim 1, the steps further comprising:

applying paper to the compressed structural fiberboard; and heating the paper and compressed structural fiberboard with synthetic oil heaters to activate glue on the paper and adhere the paper to the compressed structural fiberboard.

4. The method for making compressed structural fiberboard as stated in claim 1, the steps further comprising:

heat sink cooling the compressed structural fiberboard by passing the compressed structural fiberboard through a heat sink track cooler.

5. The method for making a compressed structural fiberboard as stated in claim 1, the steps further comprising:

water jet cutting the continuous compressed structural fiberboard into individual fiberboards.

6. The method for making a compressed structural fiberboard as stated in claim 1, the steps further comprising:

conveying the compressed structural fiberboard with variable drives on conveyors; and monitoring and controlling the speed of the variable drives through the use of the programmable logic controller.

7. The method for making a compressed structural fiberboard as stated in claim 1, the steps further comprising:

unloading the compressed structural fiberboard onto a pneumatic air table configured to adjust for height and weight of the compressed structural fiberboard.

8. An efficient apparatus for making a compressed structural fiberboard from agricultural fibrous matter, comprising:

a conveyor having first variable speed drives for carrying the agricultural fibrous matter;

a hopper having second variable speed drives for conditioning and delivering the agricultural fibrous matter to an extruder; and the extruder having a cyclic ram with electric linear actuators and a floating plate to drive the cyclic ram between an extended position, wherein the agricultural fibrous matter is compacted into the compressed structural fiberboard, and a retracted position, wherein the agricultural fibrous matter is delivered to the extruder.

9. The apparatus for making a compressed structural fiberboard as stated in claim 8, further comprising:

a synthetic oil heater for heating and activating lignin in the agricultural fibrous matter for forming the compressed structural fiberboard.

10. The apparatus for making a compressed structural fiberboard as stated in claim 8, further comprising:

a synthetic oil heater for heating and activating glue on paper to adhere the paper onto the compressed structural fiberboard.

11. The apparatus for making a compressed structural fiberboard as stated in claim 8, further comprising:

a heat sink track cooler for cooling the compressed structural fiberboard by engaging the compressed structural fiberboard with metal panels.

12. The apparatus for making a compressed structural fiberboard as stated in claim 11:

the heat sink track cooler having opposing tracks that provides resistance to the compressed structural fiberboard to provide back pressure to the extruder.

13. The apparatus for making a compressed structural fiberboard as stated in claim 8, further comprising:

a water jet cutting system for clamping and cutting the compressed structural fiberboard into individual boards.

14. The apparatus for making a compressed structural fiberboard as stated in claim 8, further comprising:

a pneumatic air table for loading and unloading the compressed structural fiberboard.

15. The apparatus for making a compressed structural fiberboard as stated in claim 8, further comprising:

a programmable logic controller for monitoring and controlling the speed of the first and second variable speed drives.

* * * * *